US007953605B2

(12) United States Patent
Sinha et al.

(10) Patent No.: US 7,953,605 B2
(45) Date of Patent: May 31, 2011

(54) METHOD AND APPARATUS FOR AUDIO ENCODING AND DECODING USING WIDEBAND PSYCHOACOUSTIC MODELING AND BANDWIDTH EXTENSION

(76) Inventors: Deepen Sinha, Chatham, NJ (US); Anibal J. S. Ferreira, Sao Mamede Infesta (PT); Erumbi Vallabhan Harinarayanan, Noida (IN)

( * ) Notice: Subject to any disclaimer, the term of this patent is extended or adjusted under 35 U.S.C. 154(b) by 1272 days.

(21) Appl. No.: 11/544,901

(22) Filed: Oct. 6, 2006

(65) Prior Publication Data

US 2007/0238415 A1 Oct. 11, 2007

Related U.S. Application Data

(60) Provisional application No. 60/724,856, filed on Oct. 7, 2005.

(51) Int. Cl.
*G10L 19/00* (2006.01)

(52) U.S. Cl. ..... 704/501; 704/500; 704/200.1

(58) Field of Classification Search ..... None
See application file for complete search history.

(56) References Cited

U.S. PATENT DOCUMENTS

| | | | | |
|---|---|---|---|---|
| 6,680,972 | B1 | 1/2004 | Liljeryd et al. | |
| 7,460,990 | B2 * | 12/2008 | Mehrotra et al. | 704/206 |
| 7,483,758 | B2 * | 1/2009 | Liljeryd et al. | 700/94 |
| 7,630,882 | B2 * | 12/2009 | Mehrotra et al. | 704/205 |
| 7,813,931 | B2 * | 10/2010 | Hetherington et al. | 704/500 |
| 2005/0165611 | A1 | 7/2005 | Mehrotra et al. | |
| 2010/0211399 | A1 * | 8/2010 | Liljeryd et al. | 704/500 |

* cited by examiner

*Primary Examiner* — Talivaldis Ivars Smits
(74) *Attorney, Agent, or Firm* — Thomas L. Adams

(57) ABSTRACT

A novel bandwidth extension technique allows information to be encoded and decoded using a fractal self similarity model or an accurate spectral replacement model, or both. Also a multi-band temporal amplitude coding technique, useful as an enhancement to any coding/decoding technique, helps with accurate reconstruction of the temporal envelope and employs a utility filterbank. A perceptual coder using a comodulation masking release model, operating typically with more conventional perceptual coders, makes the perceptual model more accurate and hence increases the efficiency of the overall perceptual coder.

81 Claims, 14 Drawing Sheets

$$Y = \begin{bmatrix} y_1 & y_2 & y_3 & \cdot & \cdot & \cdot & y_n \end{bmatrix}$$

$$X = \begin{bmatrix} x_1 & x_2 & x_3 & \cdot & \cdot & \cdot & x_n \end{bmatrix}$$

FIG 10

$$X_L = \begin{bmatrix} x_{L1} \\ x_{L2} \\ x_{L3} \\ \cdot \\ \cdot \\ \cdot \\ x_{Ln} \end{bmatrix}$$

$$X_R = \begin{bmatrix} x_{R1} \\ x_{R2} \\ x_{R3} \\ \cdot \\ \cdot \\ \cdot \\ x_{Rn} \end{bmatrix}$$

FIG 11

FIG 12

$$\bar{X}_L = \begin{bmatrix} (x_{L1} - x_{R1})/2 \\ (x_{L2} - x_{R2})/2 \\ (x_{L3} - x_{R3})/2 \\ \cdot \\ \cdot \\ \cdot \\ (x_{Ln} - x_{Rn})/2 \end{bmatrix}$$

$$X_R = \begin{bmatrix} (x_{L1} + x_{R1})/2 \\ (x_{L2} + x_{R2})/2 \\ (x_{L3} + x_{R3})/2 \\ \cdot \\ \cdot \\ \cdot \\ (x_{Ln} + x_{Rn})/2 \end{bmatrix}$$

METHOD AND APPARATUS FOR AUDIO ENCODING AND DECODING USING WIDEBAND PSYCHOACOUSTIC MODELING AND BANDWIDTH EXTENSION

CROSS-REFERENCES TO RELATED APPLICATIONS

This application claims the benefit of U.S. Provisional Patent Application, Ser. No. 60/724,856, filed 7 Oct. 2005, the contents of which are hereby incorporated by reference herein.

BACKGROUND OF THE INVENTION

1. Field of the Invention

The present invention relates to coding and decoding of audio signals to reduce transmission bandwidth without unacceptably degrading the quality of the reconstructed signal.

2. Description of Related Art

Many techniques exist in the field of audio compression for encoding a signal that can later be decoded without significant loss of quality. A common scheme is to sample a signal and use these samples to produce a discrete frequency transform. Varieties of transforms exist such as Discrete Fourier Transform (DFT), Odd-frequency Discrete Fourier Transform (ODFT), and Modified Discrete Cosine Transform (MDCT).

Also, transmission bandwidth can be conserved by sending only lower frequency (base band) spectral components. To restore the higher frequency components on the decoding side, various bandwidth extension techniques have been proposed. A simple technique is to take the base band components and scale them up in frequency.

Also, certain frequency components are difficult to perceive by the human ear when they are close in frequency to a dominant, high energy component. Accordingly, such dominant components can have associated with them a masking function to attenuate nearby frequency components, the attenuation being greater the closer a component is to the dominant masking component. Techniques of this type are part of the field of perceptual coding.

The field of perceptual coding for audio coding has been an active one over the past two decades. Typical configuration for the perceptual model used in audio codecs such as PAC, AAC, MPEG-LayerIII etc. may be found in [1-5].

1. J. D. Johnston, D. Sinha, S. Dorward, and S. R. Quackenbush, "AT&T Perceptual Audio Coding (PAC)," in AES Collected Papers on Digital Audio Bit-Rate Reduction, N. Gilchrist and C. Grewin, Eds. 1996, pp. 73-82.
2. Kyoya Tsutui, Hiroshi Suzuki, Mito Sonohara Osamu Shimyoshi, Kenzo Akagiri, and Robert M. Heddle, "ATRAC: Adaptive Transform Acoustic Coding for MiniDisc," 93$^{rd}$ Convention of the Audio Engineering Society, October 1992, Preprint n. 3456.
3. K. Bradenburg, G. Stoll, et al. "The ISO-MPEGAudio Codec: A Generic-Standard for Coding of High Quality Digital Audio," in 92nd AES Convention, 1992, Preprint no. 3336.
4. Marina Bosi et al., "ISO/IEC MPEG-2 Advanced Audio Coding," 101st Convention of the Audio Engineering Society, November 1996, Preprint no. 4382.
5. Mark Davis, "The AC-3 Multichannel Coder," 95$^{th}$ *Convention of the Audio Engineering Society*, October 1993, Preprint n. 3774.

The centerpiece of perceptual modeling is the concept of auditory masking [11-15, 27].

11. Joseph L. Hall, "*Auditory Psychophysics for Coding Applications*," Section IX, Chapter 39, The Digital Signal Processing Handbook, CRC Press, Editors: Vijay K. Madisetti and Douglas B. Williams, 1998.
12. B. C. J. Moore, *An Introduction to the Psychology of Hearing*, 5th Ed., Academic Press, San Diego (2003).
13. Eberhard Zwicker, and Hugo Fastl, *Psychoacoustics: Facts and Models*, Springer Series in Information Sciences (Paperback), Second updated edition.
14. Anibal J. S. Ferreira, *Spectral Coding and Post-Processing of High Quality Audio*, Ph.D. thesis, Faculdade de Engenharia da Universidade do Porto-Portugal, 1998, http://telecom.inescn.pt/doc/phd en.html.
15. D. Sinha, *Low bit rate transparent audio compression using adapted wavelets*. Ph.D. thesis, University of Minnesota, 1993.
27. Nikil Jayant, James Johnston, and Robert Safranek, "Signal Compression Based on Models of Human Perception," *Proceedings of the IEEE*, vol. 81, no. 10, pp. 1385-1422, October 1993.

The goal is to quantize the audio signal in such a way that the quantization noise is either fully masked or rendered less annoying due to masking by the audio signal. Building of a perception model in audio codec typically involves the utilization of following four key concepts: simultaneous masking, temporal masking, frequency spread of masking, and, tone vs. noise like nature of the masker. Simultaneous masking is a phenomenon whereby a masker is found to mask the perception of a maskee occurring at the same time. Temporal masking refers to a phenomenon in which a masker masks a maskee occuring either prior to or after its occurrence. Frequency spread of masking refers to the phenomenon that a masker at a certain frequency has a masking potential not only at that frequency but also at neighboring frequencies. Finally, the masking potential of a narrow band masker is strongly dependent on the tone vs. noise like nature of the masker. These factors are utilized to estimate desired quantization accuracy, or Signal to Mask Ratio (SMR) for each band of frequency.

In many audio codecs the masking model for wideband audio signals is constructed using a two step procedure. First the (short-term) signal spectrum is analyzed in multiple partitions (which are narrower than a critical band). The masking potential of each narrow-band masker is estimated by convolving it with a spreading function which models the frequency spread of masking. The masked threshold of the wide band audio signal is then estimated by considering it to be the superposition of multiple narrow band maskers. Recent studies suggest that this assumption of superposition may not always be a valid one. In particular a phenomenon called Comodulation Release of Masking (CMR) has implication towards the extension of narrow band model to a wide band model. B. C. J. Moore, *An Introduction to the Psychology of Hearing,* 5th Ed., Academic Press, San Diego (2003). See Hall J W, Grose J H, Mendoza L (1995) Across-channel processes in masking. In: Hearing (Moore B C J, ed), pp 243-266. San Diego: Academic.

SUMMARY OF THE INVENTION

In accordance with the illustrative embodiments demonstrating features and advantages of the present invention, there is provided a method for encoding an audio signal. The method includes the step of transforming the audio signal into a discrete plurality of (a) basic transform coefficients corresponding to basic spectral components located in a base band and (b) extended transform coefficients corresponding to components located beyond the base band. Another step is correlating that is (i) based on at least some of the basic transform coefficients and at least some of the extended transform components and (ii) performed by programmatically determining and applying a primary frequency scaling parameter and a primary frequency translation parameter to form a revised relation between the basic transform coefficients and extended transform coefficients that increases their correlation. The method also includes the step of forming an encoded signal based on the basic transform coefficients, the primary frequency scaling parameter and the primary frequency translation parameter.

In accordance with another aspect of the present invention, there is provided an encoder for encoding an audio signal that includes a processor, which has a transform, a correlator and a former. The transform can transform the audio signal into a discrete plurality of (a) basic transform coefficients corresponding to basic spectral components located in a base band and (b) extended transform coefficients corresponding to components located beyond the base band. The correlator can provide a correlation that is (i) based on at least some of the basic transform coefficients and at least some of the extended transform components and (ii) performed by programmatically determining and applying a primary frequency scaling parameter and a primary frequency translation parameter to form a revised relation between the basic transform coefficients and extended transform coefficients that increases their correlation. The former can form an encoded signal based on the basic transform coefficients, the primary frequency scaling parameter and the primary frequency translation parameter.

In accordance with yet another aspect of the present invention, a method is provided for decoding a compressed audio signal signifying (a) basic transform coefficients of basic spectral components derived from a base band, (b) one or more frequency scaling parameters, and (c) one or more frequency translation parameters. The method includes the step of applying the one or more frequency scaling parameters and the one or more frequency translation parameters to the basic transform coefficients to provide a plurality of altered primary coefficients having altered spectral significance. Another step is inverting the basic transform coefficients and the altered primary coefficients to form a time-domain signal.

In accordance with still yet another aspect of the present invention, there is provided a decoder for decoding a compressed audio signal signifying (a) basic transform coefficients of basic spectral components derived from a base band, (b) one or more frequency scaling parameters, and (c) one or more frequency translation parameters. The decoder has a relocator for applying the one or more frequency scaling parameters and the one or more frequency translation parameters to the basic transform coefficients to provide a plurality of altered primary coefficients having altered spectral significance. The decoder also has an inverter for inverting the basic transform coefficients and the altered primary coefficients to form a time-domain signal.

In accordance with a further aspect of the present invention, a method is provided for encoding an audio signal. The method includes the step of transforming the audio signal into a discrete plurality of primary transform coefficients corresponding to spectral components located in a designated band. Another step is correlating based on a correspondence between at least some of the primary transform coefficients and programmatically synthesized data corresponding to a synthetic harmonic or individual sinusoids spectrum comprising any combination of one or more harmonic patterns and one or more individual sinusoids. The method also includes the step of forming an encoded signal based on at least some of the primary transform coefficients, and one or more harmonic parameters signifying one or more characteristics of the synthetic harmonic or individual sinusoids spectrum.

In accordance with another further aspect of the present invention, there is provided an encoder for encoding an audio signal. The encoder has a transform for transforming the audio signal into a discrete plurality of primary transform coefficients corresponding to spectral components located in a designated band. Also included is a correlation device for correlating based on a correspondence between at least some of the primary transform coefficients and programmatically synthesized data corresponding to a synthetic harmonic spectrum. The encoder also has a former for forming an encoded signal based on at least some of the primary transform coefficients, and one or more harmonic parameters signifying one or more characteristics of the synthetic harmonic spectrum.

In accordance with yet another further aspect of the present invention, a method is provided for decoding a compressed audio signal signifying (a) a plurality of basic transform coefficients corresponding to basic spectral components located in a base band, and (b) one or more harmonic parameters signifying one or more characteristics of a synthetic harmonic or individual sinusoids spectrum comprising any combination of one or more harmonic patterns and one or more individual sinusoids. The method includes the step of synthesizing one or more harmonically related transform coefficients based on the one or more harmonic parameters. Another step is inverting the basic transform coefficients and the one or more harmonically related transform coefficients into a time-domain signal.

In accordance with still yet another further aspect of the present invention, there is provided a decoder for decoding a compressed audio signal signifying (a) a plurality of basic transform coefficients corresponding to basic spectral components located in a base band, and (b) one or more harmonic parameters signifying one or more characteristics of a synthetic harmonic or individual sinusoids spectrum comprising any combination of one or more harmonic patterns and one or more individual sinusoids. The decoder has a synthesizer for synthesizing one or more harmonically related transform coefficients based on the one or more harmonic parameters. Also included is an inverter for inverting the basic transform coefficients and the one or more harmonically related transform coefficients into a time-domain signal.

In accordance with still yet another aspect of the present invention, a method is provided for encoding an audio signal. The method includes the step of transforming the audio signal into a discrete plurality of transform coefficients corresponding to spectral components located in a designated band, some of the transform coefficients corresponding to one or more standard time intervals and others individually corresponding to one of a plurality of subintervals within the one or more standard time intervals. Another step is forming an encoded signal based on (a) the plurality of transform coefficients associated with the one or more standard time intervals, and (b) magnitude information based on the plurality of transform coefficients associated with the plurality of subintervals.

In accordance with yet another aspect of the present invention, there is provided an encoder for encoding an audio signal. The encoder has a transform for transforming the audio signal into a discrete plurality of transform coefficients corresponding to spectral components located in a designated band, some of the transform coefficients corresponding to one or more standard time intervals and others individually corresponding to one of a plurality of subintervals within the one or more standard time intervals. The encoder also has a former for forming an encoded signal based on (a) the plurality of transform coefficients associated with the one or more standard time intervals, and (b) magnitude information based on the plurality of transform coefficients associated with the plurality of subintervals.

In accordance with yet another aspect of the present invention, a method is provided for processing a decompressed audio signal obtained from a discrete plurality of transform coefficients corresponding to one or more standard time intervals, using magnitude information based on a plurality of transform coefficients corresponding to one of a plurality of subintervals of the one or more standard time intervals. The method includes the step of inverting the discrete plurality of transform coefficients associated with the one or more standard time intervals into a first time-domain signal. Another step is successively transforming the first time-domain signal into a frequency domain to obtain a discrete plurality of local coefficients individually assigned to a plurality of successive time slots corresponding in duration to the plurality of subintervals. The method also includes the step of rescaling the plurality of local coefficients using from the compressed audio signal the transform coefficients associated with the plurality of subintervals. Another step is inverting the discrete plurality of local coefficients into a corrected time-domain signal.

In accordance with yet another aspect of the present invention, there is provided a decoding accessory for processing a decompressed audio signal obtained from a discrete plurality of transform coefficients corresponding to one or more standard time intervals, using magnitude information based on a plurality of transform coefficients corresponding to one of a plurality of subintervals of the one or more standard time intervals. The accessory has a first inverter for inverting the discrete plurality of transform coefficients associated with the one or more standard time intervals into a first time-domain signal. Also included is a transform for successively transforming the first time-domain signal into a frequency domain to obtain a discrete plurality of local coefficients individually assigned to a plurality of successive time slots corresponding in duration to the plurality of subintervals. The accessory also has a rescaler for rescaling the plurality of local coefficients using from the compressed audio signal the transform coefficients associated with the plurality of subintervals. Also included is a second inverter for inverting the discrete plurality of local coefficients into a corrected time-domain signal.

In accordance with another aspect of the present invention, a method is provided for encoding an audio signal. The method includes the step of transforming the audio signal into at least a discrete plurality of transform coefficients corresponding to spectral components located in a designated band, the transform coefficients including a standard grouping and a substandard grouping, the standard grouping being associated with one or more standard time intervals, the substandard grouping being dividable into a plurality of isofrequency sequences, each of the plurality of isofrequency sequences encompassing the one or more standard time intervals and being associated with a corresponding one of the transform coefficients in the standard grouping, the transform coefficients of the standard grouping each being assigned a masking characteristic for perceptually attenuating spectrally nearby ones of the standard grouping according to a predefined masking function having a predefined domain. Also included is the step of weakening the masking characteristic of each of the transform coefficients in the standard grouping based on the extent its corresponding one of the isofrequency sequences varies and correlates with spectrally nearby ones of the isofrequency sequences.

In accordance with another aspect of the present invention, there is provided an encoder for encoding an audio signal. The encoder has a transform for transforming the audio signal into at least a discrete plurality of transform coefficients corresponding to spectral components located in a designated band, the transform coefficients including a standard grouping and a substandard grouping, the standard grouping being associated with one or more standard time intervals, the substandard grouping being dividable into a plurality of isofrequency sequences, each of the plurality of isofrequency sequences encompassing the one or more standard time intervals and being associated with a corresponding one of the transform coefficients in the standard grouping, the transform coefficients of the standard grouping each being assigned a masking characteristic for perceptually attenuating spectrally nearby ones of the standard grouping according to a predefined masking function having a predefined domain. Also included is a weakener for weakening the masking characteristic of each of the transform coefficients in the standard grouping based on the extent its corresponding one of the isofrequency sequences varies and correlates with spectrally nearby ones of the isofrequency sequences.

The present audio bandwidth extension (BWE) technique is based upon two algorithms, namely Accurate Spectral Replacement (ASR) and Fractal Self-Similarity Model (FSSM). The ASR technique is described in a paper by Anibal J. S. Ferreira and Deepen Sinha, "Accurate Spectral Replacement," 118*th Convention of the Audio Engineering Society*, May 2005, Paper 6383, which paper is incorporated herein by reference. The FSSM and ASR technique are described in a paper by Deepen Sinha, Anibal Ferreira, and, Deep Sen "A Fractal Self-Similarity Model for the Spectral Representation of Audio Signals," 118*th Convention of the Audio Engineering Society*, May 2005, Paper 6467; and Deepen Sinha, and Anibal Ferreira, "A New Broadcast Quality Low Bit Rate Audio Coding Scheme Utilizing Novel Bandwidth Extension Tools," 119*th Convention of the Audio Engineering Society*, October 2005, Paper 6588 of the which papers are incorporated herein by reference.

The ASR and FSSM techniques work directly in the frequency domain with a high frequency resolution representation of the signal. These representations are supplemented by a third tool "Multi Band Temporal Amplitude Coding" (MBTAC), which ensures accurate reconstruction of the time-varying envelope of the signal representation in the frequency domain. The MBTAC tool utilizes a Utility Filterbank (UFB) that generates a frequency representation of the signal that varies in time with a relatively high time resolution to provide a time-frequency representation of the signal.

With the ASR technique the spectrum is segmented into sinusoids and residual (or noise), this residual results by removing (i.e., by subtracting) sinusoids directly from the complex discrete frequency representation of the audio signals from block 10. Coefficients for the sinusoids are coded and transmitted to the decoder.

The FSSM technique implements a bandwidth extension model employing the basic principle of creating a high frequency bandwidth from a low frequency spectrum. The model involves identifying dilation (frequency scaling) and frequency translation parameters which when applied on a low frequency band, efficiently represents the high frequency signal. Maximizing intra spectral-cross correlation is the basic criterion in choosing dilation and translation parameters. A brief functional description of FSSM's operation is as follows:

1) The dilation and translation parameters are estimated and applied to the low frequency base band to allow synthesis of a replica of the originally detected high frequency components.
2) To determine the fit of the FSSM model, the frequency spectrum may be split into multiple slices and for each slice a determination is made to either apply the model or replace it by an independent signal such as synthetic noise. The FSSM model therefore, in general, is a FSSM+Noise model.
3) The shape of the temporal and frequency envelope of the signal is an important consideration. The FSSM model may not accurately reconstruct the coarse frequency envelope and so this may coded separately.

In parallel to the above sequence of processes (which emanate from a high resolution frequency analysis), a second time-frequency analysis may be optionally performed and used to encode the time frequency envelope of the signal as well as the inter-aural phase cues. This sequence of parallel functional blocks is as follows:

A Utility Filterbank (UFB) is a complex modulated filterbank with several-times oversampling. It allows for a time resolution as high as 16/Fs (where Fs is the sampling frequency) and frequency resolution as high Fs/256. It also optionally supports a non-uniform time-frequency resolution.

Multi Band Temporal Amplitude Coding (MBTAC) involves efficient coding of two channel (stereo) time-frequency envelopes in multiple frequency bands. The resolution of MBTAC frequency bands is user selectable. The envelope information is grouped in time and frequency and jointly coded (across two channels) for coding efficiency. Various noiseless coding tools are used to reduce bit demand.

The present disclosure also has a perceptual model employing psychometric data and results related to comodulation release of masking.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein:

FIG. 10 is a vector representation of the waveforms of FIG. 9;

FIG. 11 is a vector representation of right and left channels as employed in the encoder of FIG. 1 and a decoder of FIG. 2;

FIG. 12 is a vector representation of right and left channels employing sum and difference factors, which is an alternate to that shown in FIG. 11;

DETAILED DESCRIPTION OF THE PREFERRED EMBODIMENTS

Figure 1:
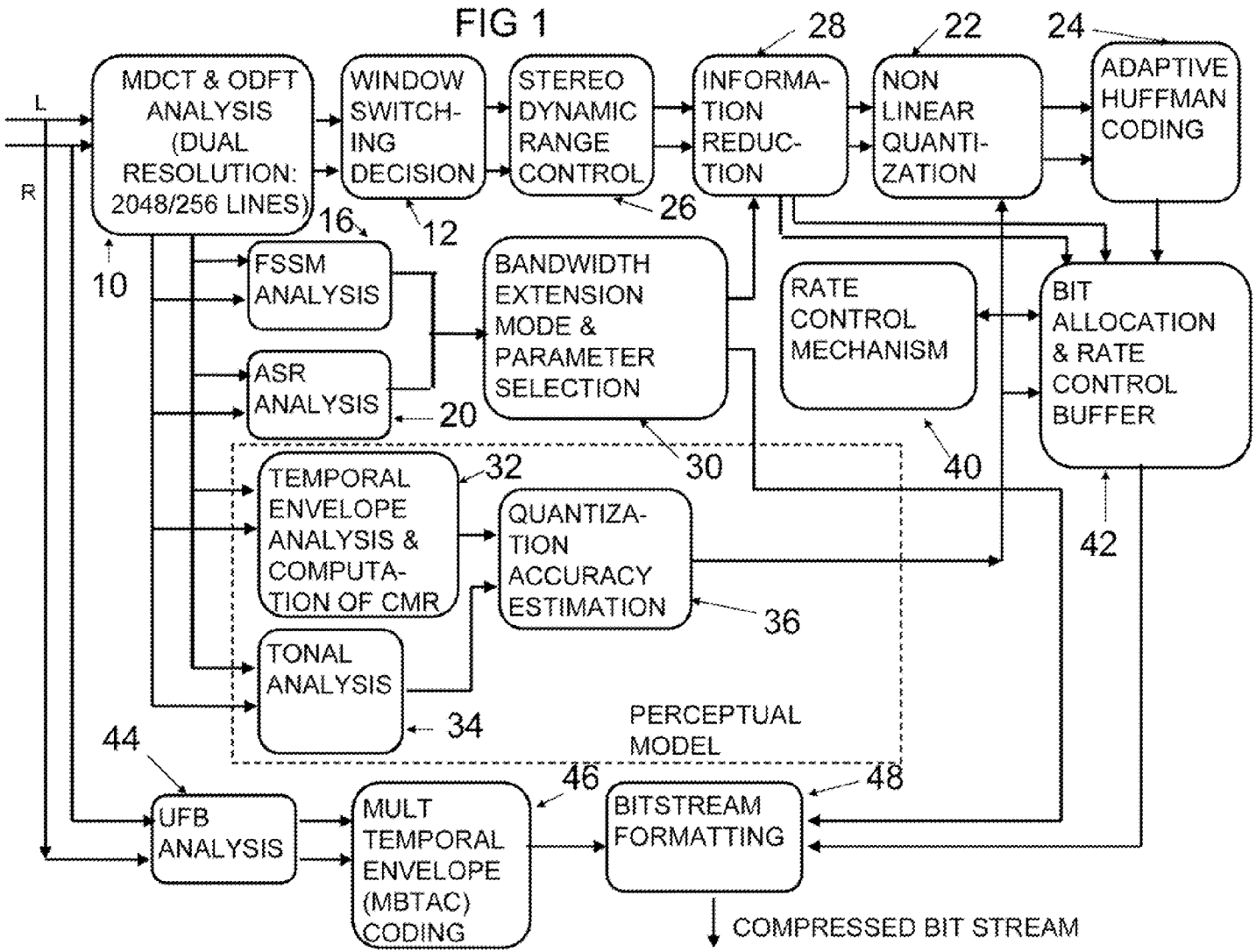
FIG. 1 is a block diagram of an encoder implementing an encoding method in accordance with principles of the present invention.
Figure 3:
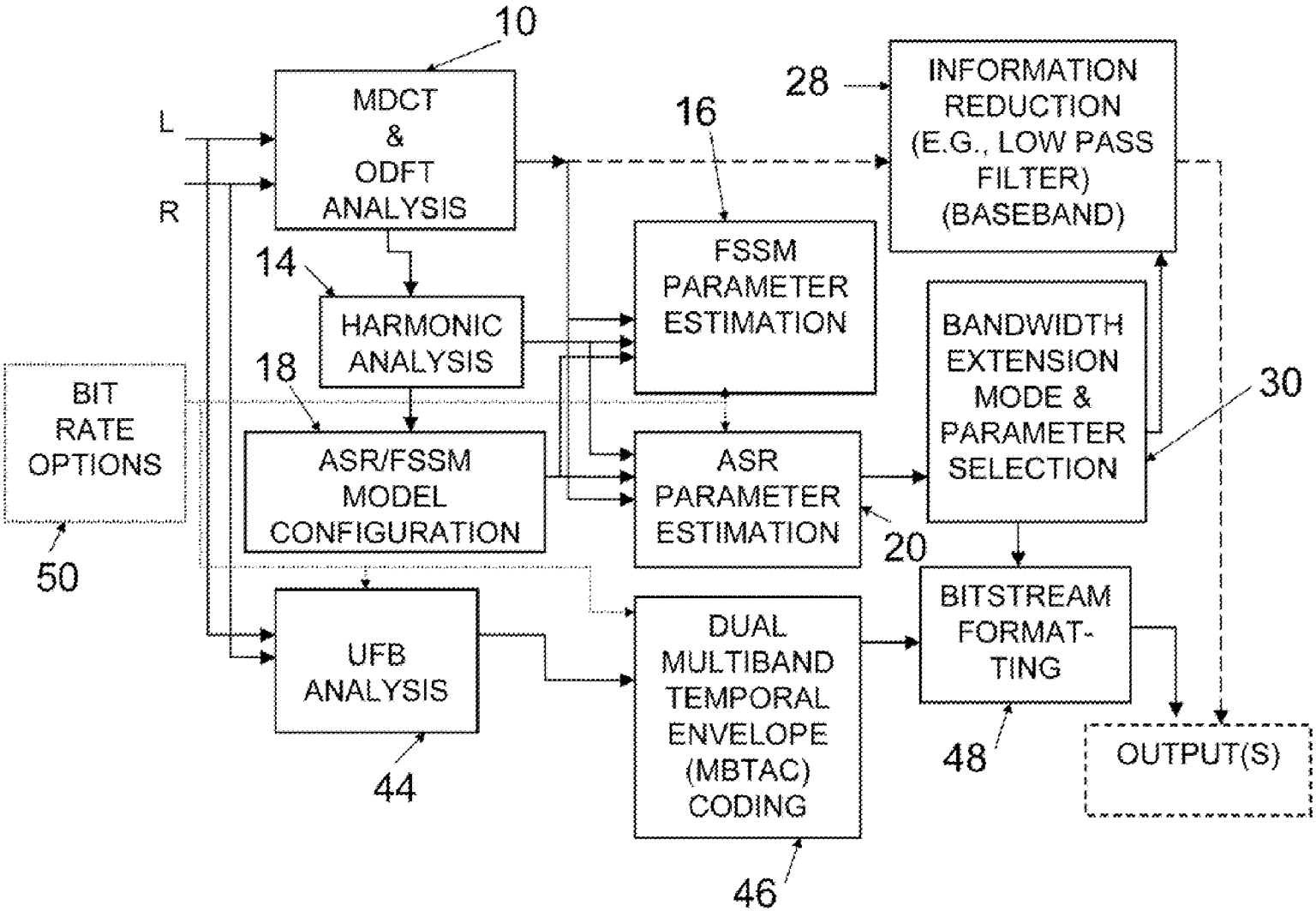
FIG. 3 is a more detailed block diagram of portions of the diagram of FIG. 1.

Referring to FIGS. 1 and 3, an encoder apparatus and method is described by means of a block diagrams indicating certain algorithms performed on a processor, such as a microprocessor, dedicated computerized controller, personal computer, or more general purpose computer. Input to the system consists of sampled digital audio, specifically 16 or 24 bit PCM Stereo (Left/Right) with a sampling frequency Fs (illustrative values for Fs are 44100 Hz and 32000 Hz). High resolution frequency analysis (MDCT/ODFT) is performed in the first block 10 of the encoder/BWE encoder for one frame of audio (illustratively a frame of audio consists of 1024 samples). It simultaneously computes the MDCT and ODFT representation (for two channels L and R (left and right). The MDCT/ODFT analysis is computed for two frequency resolutions: (i) a Long window which is typically 2048 samples long (with 1024 sample overlap between two consecutive windows), (ii) a Short window which is typically 256 samples long (with 128 sample overlap between two consecutive windows).

Block 10 is herein referred to as a transform for producing a plurality of transform coefficients (sometimes referred to as primary transform coefficients located in a designated band) indicating the magnitude or entity all discrete spectral components. These transform coefficients may be may be segregated into basic transform coefficients corresponding to basic spectral components located in a base band and extended transform coefficients that may not be directly encoded but many be simulated by the herein disclosed bandwidth extension method. The basic transform coefficients may be encoded and individually transmitted.

A window type detector 12 is applied to decide the window structure (Long/Short window) to be used to establish an input frame appropriate to avoid pre-echo condition; in other words, a trade off on time-frequency resolution is done based on the stationarity of the input frame. Specifically, detector 12 selects an increased time resolution (short window) for a non-stationary frame and an increased frequency resolution (long window) for a stationary frame. In case of a window state transition a well-known Start or Stop window is suitably inserted.

The present codec utilizes an algorithm for the detection and accurate parameter estimation of sinusoidal components in the signal. The algorithm may be based on the work by Anibal J. S. Ferreira and Deepen Sinha, "Accurate and Robust Frequency Estimation in ODFT Domain," in 2005 *IEEE Workshop on Applications of Signal Processing to Audio and Acoustics*, Oct. 16-19, 2005; and Anibal J. S. Ferreira, "Accurate Estimation in the ODFT Domain of the Frequency, Phase and Magnitude of Stationary Sinusoids," in 2001 *IEEE Workshop on Applications of Signal Processing to Audio and Acoustics*, Oct. 21-24 2001, pp. 47-50.

The detected sinusoids may be further analyzed for the presence of harmonic patterns using techniques similar to that described by Anibal J. S. Ferreira, "Combined Spectral Envelope Normalization and Subtraction of Sinusoidal Components in the ODFT and MDCT Frequency Domains," in 2001 *IEEE Workshop on Applications of Signal Processing to Audio and Acoustics*, Oct. 21-24 2001, pp. 51-54.

Figure 5:
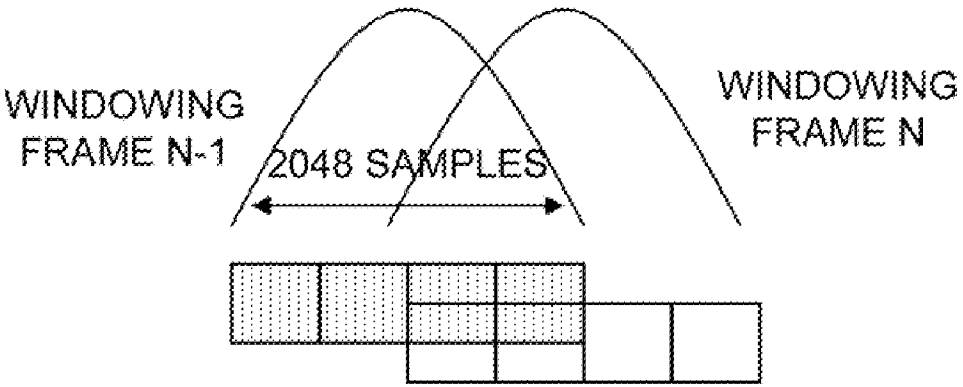
FIG. 5 is a diagram showing the process of applying long windows on a stationary frame with the transform of FIG. 1.

Depending on the chosen window (Long window=1024/Short window=128) MDCT and ODFT coefficients are calculated as graphically indicated in FIG. 5. The MDCT filter bank takes advantage of ODFT coefficients in that the results of the MDCT analysis filter bank can be decomposed from the results of the complex ODFT filter bank. The ODFT provides magnitude and phase information. The MDCT, ODFT and ODFT to MDCT transformation is as given below.

$$X_M(K) = \sum_{n=0}^{N-1} h(n)x(n)\cos\left[\frac{2\pi}{N}(k+1/2)(n+n_0)\right]$$

where $X_M(K)$ is MDCT of the input sequence x(n) and h(n) is the windowing function and $n_0=\frac{1}{2}+N/4$.

Taking $0 \leqq K \leqq N/2-1$ it can be shown that, $$X_M(K)=Re(X_0(K))\cos\theta(K)+Im(X_0(K))\sin\theta(K)$$

$$\theta(K) = \frac{\pi}{N}(K+1/2)(1+N/2).$$

ODFT of a sequence x(n) is defined as:

$$X_0(K) = \sum_{n=0}^{N-1} h(n)x(n)e^{-j\frac{2\pi}{N}(K+1/2)n}$$

ODFT of two channels is computed using an efficient algorithm described in. the TechOnline Paper "A Fast Algorithm for Computing Two Channel Odd Frequency Transforms with Application to Audio Coding" Sinha, N. and Ferreira J. S. TechOnline October 2005. The default window shape used in ODFT analysis is the sine window. Higher order smooth windows as described in the Sinha Ferreira Paper in AES $120^{th}$ convention, NY may also be used for this analysis. In case of a Long to Short (Short to Long) transition the Long window immediately preceding (following) the Short window has a special non-symmetrical shape characterized as a Start (Stop) window. In such a case the ODFT/MDCT analysis is recomputed using the appropriate transition window shape.

The MDCT components thus produced are processed using a conventional stereo dynamic range control in block 26 before being bandwidth limited in block 28 for purposes to be described presently. Thereafter, the magnitudes associated with the bandwidth limited components of the baseband are quantized in block 22. The quantizing steps can be adjusted dynamically in a manner to be described hereinafter. Thereafter, entropy coding can be performed in block 24, which implements the well-known Huffman coding technique. Since the entropy coding can produce a time varying bit rate, a buffer is used in block 42, which is controlled by a rate control mechanism in block 40 in a conventional manner. The final results of the processing in this main channel are forwarded to bitstream formatting block 48, which combines data from this channel with other data to form a bitstream having an appropriate transport protocol.

Pyschoacoustic Model

The present codec includes a perceptual coding scheme whereby a sophisticated psychoacoustic model is employed to quantize the output of an analysis filter bank.

Two key aspects of the present psychoacoustic model pertains respectively to the extension of a narrow band masking model to wide band audio signals and to the accurate detection of tonal components in the signal.

In block 34 a conventional tonal analysis is performed and its results are forwarded to the quantizing control block 36, which connects to the quantizer 22 in the main channel.

Unlike conventional perceptual models, analysis is performed in block 32 taking into account comodulation release (CMR). Comodulation release is a phenomenon that suggests reducing conventional masking in the presence of a wide band (bandwidth greater than a critical band) noise-like signal which is coherently amplitude modulated (comodulated) over the entire spectrum range covered by a masking function. The reduction in masking has been variously reported to be between 4.0 dB to as high as 18 dB. See Jesko L. Verhey, Torsten Dau, and Birger Kollmeier "Within-channel cues in comodulation masking release (CMR): Experiments and model predictions using a modulation filter bank model" Journal of the Acoustical Society of America, 106(5), p. 2733-2745.

The exact physiological phenomenon responsible for CMR is still being investigated by various researchers. However, there is some evidence that CMR occurs due to a combination of multiple factors. It has been hypothesized that the masking release results from cues available within a critical band and from cues generated by comparisons across critical bands. In audio codecs this implies that superposition of masking does not hold in the presence of strong temporal envelope and masking of wide band signals can be significantly lower than the sum of masking due to individual narrow (sub-critical) band components depending upon the coherence of their temporal envelopes. It is tempting to think that CMR can be accounted for through adequate temporal shaping of the quantization noise (since the masking threshold during the dips in envelope is very likely to be lower), but experiments indicate that (the lack of) temporal shaping of maskee does not explain all (or most) of the CMR phenomenon. In particular masking release of about 4-8 dB should be accounted for directly in the psychoacoustic model.

The present psychoacoustic model works with the short windows (substandard grouping) produced by block 10 so that some finer time variation is obtained about the temporal envelope for the frequency components of the critical bands (one or more isofrequency sequences formed from the substandard grouping). In this specification, the long windows are considered part of a standard grouping and are associated with one or more standard time intervals, where the isofrequency sequences encompass one or more standard time intervals.

A CMR model is incorporated which takes into account: (i) the effective bandwidth of the $i^{th}$ critical band masker (masking value), $EBM_i$ defined as $$EBM_i = \frac{1}{2N}\sum_{j=i-N}^{j=i+N,\ j\neq i} < \phi_i, \phi_j > \tag{1}$$

where $\phi_i$ and $\phi_j$ are respectively the normalized temporal envelopes of $i^{th}$ and $j^{th}$ critical band maskers (a suitable value for N is about 5); and, (ii) dip in the temporal envelope of the masker, ρ (having an individual value defined for each critical band as the peak to valley ratio between the minimum and maximum of the temporal envelope of the masker in a 20-30 msec window). Estimation for the reduced masking potential of the narrowband masker, i, ($CMRCOMP_i$) is then made as below $$CMRCOMP_i = -10\log_{10}[\rho/N(EBM_i)] \tag{2}$$

where N(α) is a non-linearity and the $CMRCOMP_i$ value in (2) is saturated to a minimum of 0 dB (a piecewise linear function with a linear rise for α below 0.7 and above 0.8 and rapid rise angle of over 80° for αbetween 0.7 and 0.8 was found suitable in our experiments). Therefore, each narrowband masker is reduced in accordance with $CMRCOMP_i$. Partial support for this model is based on data in Verhey et al., supra, and is supported by listening data based on expert listeners. The estimated CMR compensation is utilized when combining the masking effect of multiple bands.

Basically, the masking characteristic (a predefined masking function with a predefined domain) ordinarily assigned to transform coefficients of the standard grouping are weakened (with a weakener in block 32) based on the comodulation value, $CMRCOMP_i$.

Bandwidth Extension

The transform coefficients from block 10 are to be segregated into basic transform coefficients in a low-frequency base band and extended transform coefficients located above the base band. The basic transform coefficients will be processed in a main channel as MDCT coefficients capable of representing a signal with relatively high fidelity (these are directly coded using either a conventional perceptual coding technique or its extensions described herein). Other parameters indicating qualities of the extended transform coefficients located beyond the base band.

Harmonic analysis block 14 (shown in FIG. 3 with an input coupled to block 10 and outputs coupled to blocks 16, 18 and 20) can detect all significant tonal components (magnitude above average) in the ODFT representation produced by block 10. These tonal components are further analyzed in block 14 to determine if these fit into a harmonic structure (the possibility of missing harmonics is allowed). Accordingly, block 14 acts as a correlation device when finding such harmonic structure. Accurate spectral replacement (ASR) model parameter estimation block 20 and fractal self-similarity model (FSSM) block 16 each has inputs coupled to blocks 10, 14 and 18.

ASR/FSSM Model Configuration block 18 has an input coupled to block 14. Block 18 can be configured (either permanently or based on user selected parameters) to issue control signal for specifying processing issues, such as processing order (ASR or FSSM first), components to be handled by ASR and FSSM, allowed number of harmonic patterns to be coded, bandwidth extension range, etc. See Table 1, which is discussed further hereinafter. Accordingly, FSSM block 16 and ASR block 20 will respond to this control signal and code accordingly the specified frequency structures (harmonics and tones).

While the present embodiment employs both an FSSM block 16 and ASR block 20, other embodiments may employ only one of them.

In ASR block 20 the spectrum is segmented into sinusoids and residual (or noise-like frequency components). This residual is created by removing (i.e., by subtracting) sinusoids directly from the complex discrete frequency representation of the audio signals from block 10. Coefficients for the sinusoids are coded with sub-bin accuracy and transmitted to the decoder.

Figure 6:
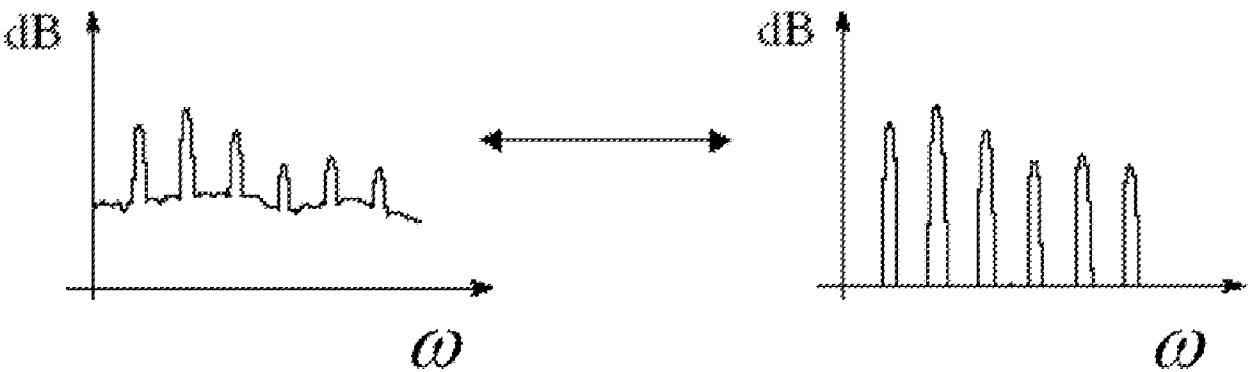
FIG. 6 diagrammatically illustrates the detection of harmonic components in a base band as performed by the encoder of FIG. 1.

Referring again to accurate harmonic analysis block 14, this block identifies sinusoidal components from the input spectrum by identifying peaks in the fine structure of the spectral-envelope, harmonic structures present, if any, and strong high frequency (HF) tonals from the input spectrum produced by block 10. Identifying peaks in the fine structure of the spectral-envelope and strong HF tonals is a simple peak picking process. Detecting harmonic structure is a more complex process involving identification of relevant structures of sinusoids harmonically related in a way that is tolerant to local harmonic discontinuities,. A condition for a harmonic structure to be recognized as such is that it contains at least four sinusoids. Alternatively, strong sinusoids not harmonically related may also be coded individually in case their spectral power exceeds a fraction of the total power of the audio signal. The results of detecting and separating harmonics and strong tonals is graphically illustrated in FIG. 6

Specifically, the algorithm of block 14 identifies the envelope of the spectrum. Spectral peaks and HF tonals are identified and a rough estimate of pitch is predicted from the envelope. Based on the rough estimate of pitch, harmonics with a maximum of 7 missing partials can be identified. In the process of identifying harmonic structure, pitch value is constantly updated on a per frame basis to match the original pitch of the spectrum.

Harmonic analysis block 14 models the input spectrum as a sum of harmonics plus noise-like components. The analysis involves identifying the harmonics to be removed from the spectrum. The analysis can be understood by considering the underlying signal as a spectrally spaced plurality of time-domain signals x(n) that can be viewed as sharply distinct harmonics among other components that fit within a smoother, almost noise-like spectrum, as follows:

$$x(n) = \sum_{n_1}\sum_{k} A_{n_1,k}\sin(n_1 \cdot f_k\pi + \phi_k) + \sum \text{noisy_sin}usoids$$

where $f_k$ is the fundamental frequency and $\phi_k$ is the phase of the $k^{th}$ harmonic; and $n_1$ are the partial corresponding to a harmonic sequence (for a non-harmonic tone only one partial will be present). Harmonic analysis results in identification of values of $An_1$,k, $f_k$ and $\phi_k$. The spectrum remaining after removing the harmonics (and in some cases the tonal peaks) may be relatively flat and can be adequately represented by a flat (white noise) spectrum represented by a limited number of noise parameters indicating the envelope of a flattened noise spectrum. In other cases, the flattened spectrum will be subjected to analysis with the FSSM model.

While the harmonic components found among the coefficients produced by block 10 will normally be most efficiently handled by the ASR model of block 20, the ultimate choice of coding the harmonic structures using either ASR or FSSM is left to the user as a configuration parameter. If the user configures a flag in block 18 indicating a predominant FSSM mode, the strongest of existing harmonics structures is modeled by FSSM in a manner to be described presently. In the absence of this flag both harmonics are modeled by the ASR algorithm of block 20.

Block 18 also assigns harmonics to the ASR block 20 and FSSM block 16 based on maximum allowable number of harmonics to be coded through ASR block 20, which is established either as a hard coded limit or as one modified by a user-defined parameter. Block 18 also resolves any overlap of frequencies between the tonals and harmonics for both the channels (Left/Right) and also resolves any overlap of frequencies between the channel's HF and harmonic structures.

ASR Parameter Estimation

Figure 7:
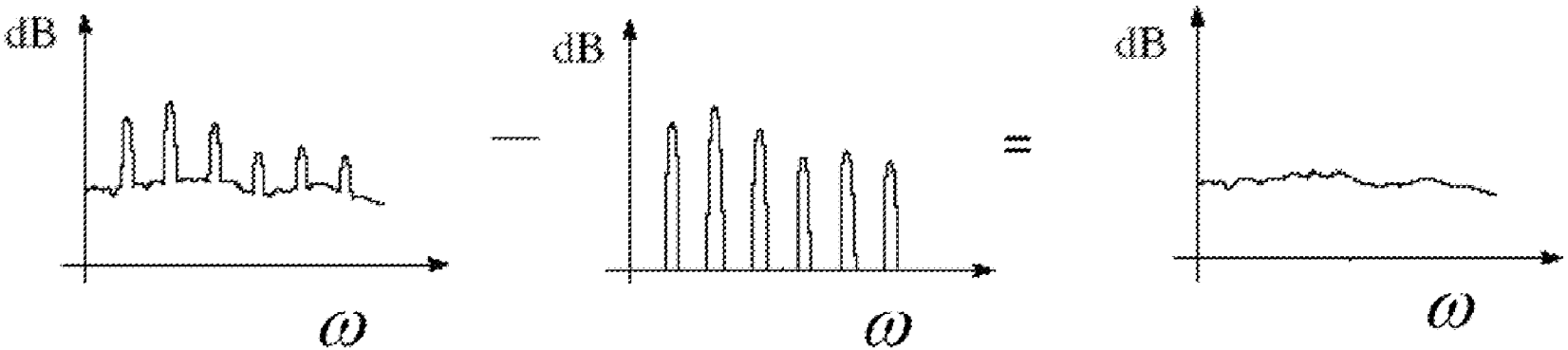
FIG. 7 diagrammatically illustrates on the left an original spectrum, detection of harmonics and tonals (central diagram) to produce a residual spectrum, using the encoder of FIG. 1.

ASR parameter estimation is performed in block 20, which generates parameters indicating the structure for certain harmonic and tonal values that are assigned to ASR processing by the model configuration block 18. These synthetically generated sinusoids are removed (subtracted) from the input spectrum of from block 10 to give a flattened spectrum that is graphically illustrated in FIG. 7. The high frequency tonals are also removed to further flatten the noise/residual of the input spectrum. Parameters indicating the foregoing harmonics and tonals (to be eventually used in reconstructive synthesis) are quantized and coded in blocks 22 and 24.

The foregoing assumed long windows. For short windows the tonal removal is done using a different approach. Until the transition frame, for a short window, tonals are removed using the parameters computed from the previous long window frame and after the transition frame, the tonal parameters from the from the future long window frame are used for synthesis.

For the purpose of ASR parameter estimation. the time-domain representation may be modeled as:

$$x(n) = \sum_{n_1} \sum_{k} A_{n_1,k} \sin(n_1 \cdot f_k \pi + \phi_k) + \sum \text{noisy_sin}usoids$$

where x(n) is the time-domain representation of the original signal that was analyzed during harmonic analysis; $f_k$ is the one or more fundamental frequencies and $\phi_k$ is the phase of the $k^{th}$ harmonic; and $n_1$ are the partials corresponding to a harmonic sequence. Also, continuing with the time-domain representation yields $$x_1(n) = \sum_{n_1} \sum_{k} A_{n_1,k} \sin(n_1 \cdot f_k \pi + \phi_k)$$

where $x_1(n)$ is the proposed combination of synthetically generated harmonics which uses parameters identified by the harmonic analysis block 14. Depending upon the bit rate and configuration of the codec, the phase parameter $\phi_k$ may either not be used or used only at the "birth" of a harmonic sequence and then computed for the subsequent frames (e.g. long windows) using a "harmonic continuation algorithm". In addition, $$y(n)=x(n)-x_1(n)=\Sigma\text{noisy_ sin usoids}$$

where, y(n) is the residual after the ASR parameter estimation block removes harmonics to yield a noise-like spectrum (note, for missing partials no removal is necessary and therefore the indicated subtraction will not actually occur). Removal of such harmonics or strong tonals is herein referred to as elimination of dominant ones of the basic transform coefficients in the base band. The coefficients to be removed are selected by determining whether their magnitude exceeds to give an extent the magnitudes in predefined neighborhoods (e.g., a predetermined number of dB greater than the average in a predefined guard band, such as ±4 kHz).

Accordingly, the ASR technique results in an abbreviated list of parameters signifying one or more characteristics of a synthetic harmonic spectrum. In order to allow later reconstruction, each harmonic structure will be represented by (a) a fundamental frequency existing in the base band, the other harmonics being assumed to be integer multiples of that fundamental frequency, (b) an optional phase. parameter related to either the fundamental or one of the harmonics in either the base band or the extended band, and (c) optional magnitude information. The magnitude information can be explicitly sent as a shape parameter indicating the declination of the harmonics from one harmonic to the next. Such shape is efficiently coded using signal normalization using a smooth spectral envelope model that can be estimated using conventional (Linear Predictive Coding) LPC-based techniques, cepstrum-based techniques or other appropriate modeling techniques; and is described by a compact set of parameters. In some embodiments no explicit magnitude information will be sent as part of the ASR process, but some magnitude tailoring will be accomplished as part of the MBTAC process described below.

FSSM Parameter Estimation:

The FSSM algorithm executed in block 16 includes a correlator categorizer and developer and is used for extension of bandwidth for higher frequencies based on low frequency spectrum values using the following programmatically determined and applied estimates of dilation and translation parameters. An introduction to the concept of FSSM is given followed by the functional implementation of FSSM in a BWE decoder.

The working of FSSM, described in detail, can be mathematically represented as a summation of terms with each having an iterative form, as indicated below:

$$\overline{X}_{HP}(f) = \ldots EO_i \circ (\ldots (EO_1 \circ (EO_0 \circ \overline{X}_{LP}(f)) \ldots)$$

Where each expansion operator $EO_i$, is assumed to have the form:

$$EO_i \circ \overline{X}_{LP}(f) = H_j \bullet X_{LP}(\alpha_i f - f_i)$$

Figure 8:
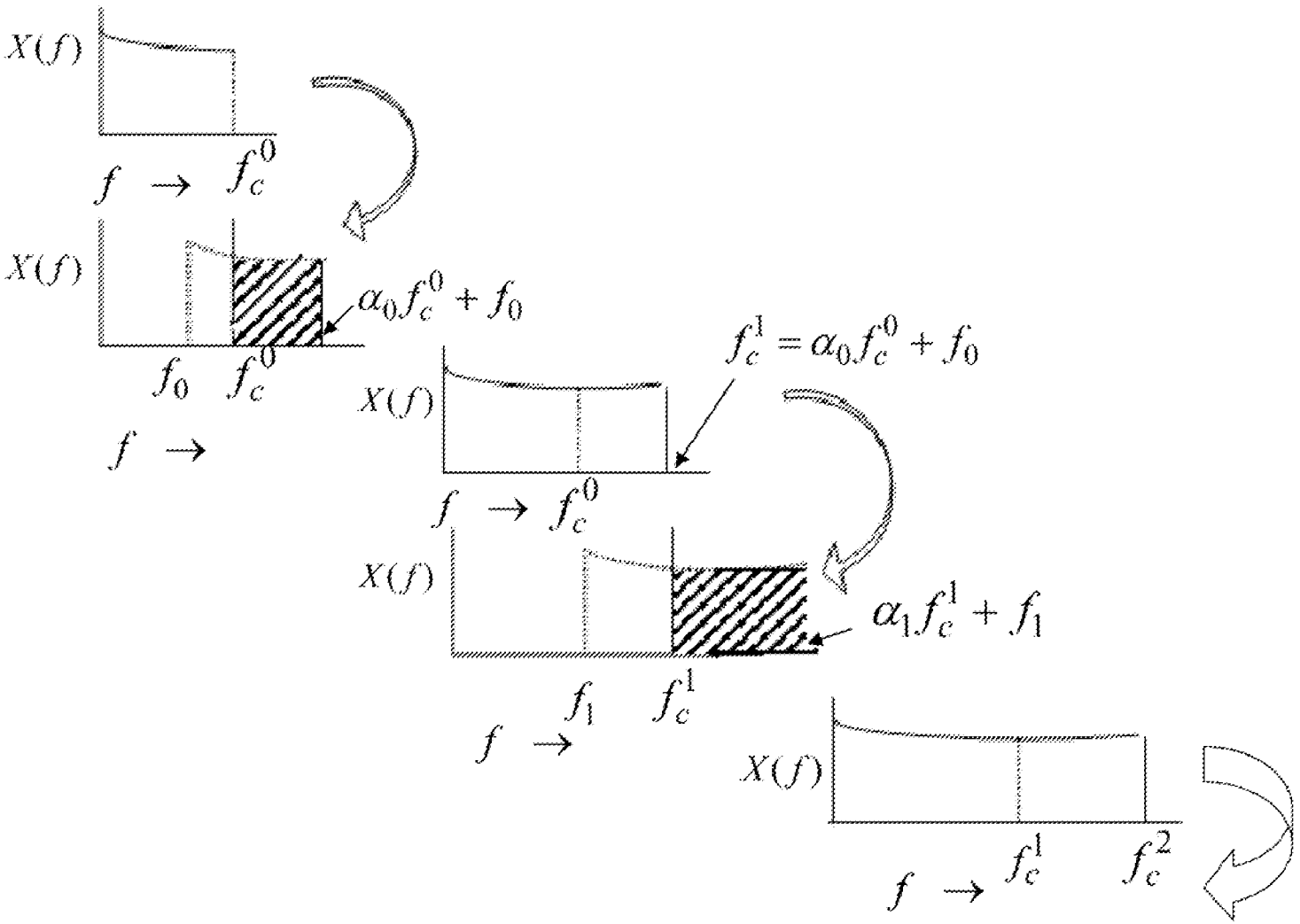
FIG. 8 diagrammatically illustrates the FSSM process of extending/reconstructing bandwidth using nested iterations with the encoder of FIG. 1, as well as the decoder of FIG. 3.

Where, $\alpha_i$ is a dilation parameter ($\alpha_i \leqq 1$) and $f_i$ is a frequency translation parameter (although in some embodiments dilation parameters greater than one may be employed). $H_i$ is a high pass filter with a cut-off frequency $$f_c^i = \alpha_i * f_c^{(i-1)} + f_i$$

with $f_c^0 = f_c$, the baseband bandwidth. This sequence of nested expansion is graphically illustrated in FIG. 8 showing how an $n^{th}$ composite band can be composed by adding beyond the prior $((n-1)^{th})$ composite band, relocated coefficients lying in another higher band. Specifically, these relocated coefficients were relocated using an $n^{th}$ frequency scaling parameter $\alpha_n$ and an $n^{th}$ frequency translation parameter $f_n$ (i.e., an $n^{th}$ adjusted pair). Note, the first composite band will be placed after frequency $f_c$ and will proceed through M iterations (i.e., M adjusted pairs and M composite bands).

Using the correlator in block 16, the values of $\alpha_i$ and $f_i$ are chosen to maximize the cross correlation between FSSM-representative spectrum and the original spectrum. Mathematically, $\alpha_i$ and $f_i$ are chosen such that, $$\phi(\alpha_i, f_i) = \langle X(f), X(\alpha_i f - f_i) \rangle$$

with these two discrete spectra being correlated through, for example, a dot product. The correlation is maximized by programmatically adjusting the dilation and translation parameters:

$$\phi(\overline{\alpha}_i, \overline{f}_i) = \max \phi(\alpha_i, f_i), \forall \alpha_i \epsilon A, f_i \epsilon F$$

Where, A is a set of possible values for dilation parameter $\alpha_i$ and F is the set of possible values for the translation frequency $f_i$. For the model to be meaningful for bandwidth extension, the range of A and F should be restricted such that $\alpha_i f_c + f_i > f_c + C$, $\forall \alpha_i \epsilon A$ & $f_i \epsilon F$ for some suitably chosen minimum extension band C.

The foregoing self similarity model coherence maximization criterion works well in many cases. However, in certain instances special considerations need to be taken into account as listed below:

1) In signals containing prominent harmonic structures the maximization criterion is not the best suited from a perceptual point of view. For such signals the presence of a harmonic structure as well as the fundamental frequency of the dominant harmonic can be accurately estimated. In most cases the translation parameter I best chosen as a value that ensures the continuity of the harmonic structure and the best value for the dilation parameter is close to unity.
2) Because of the nature of the MDCT filterbank fluctuation in translation parameter $f_0$ from one MDCT frame to the next can cause aliasing distortion, an "unsteady" perception for the high frequency harmonics may result. This is particularly true for signals for which a strong and steady smoothing or locking mechanism is necessary to avoid this problem.

After performing FSSM on the spectrum, the cross-correlation between spectral frequencies of the original spectrum from block 10 and the FSSM coded spectrum from block 10 is expected to be over a pre-defined threshold; if not, the FSSM parameters/results for the particular frames are discarded and the decoder generates instead synthetic noise with its envelopes following the RMS of the coded values. For a valid structure having valid dilation and translation parameters, the RMS values of the spectrum may be quantized and coded; or the magnitude shaping task may be left for the MBTAC processor-described below.

Accordingly, the output of block 16 is a sequence of ordered, adjusted pairs of frequency scaling parameters $\alpha_i$ and frequency translation parameters $f_i$ (the members $\alpha_i$, $f_1$ of the first pair being referred to herein as a primary frequency scaling parameter and a primary frequency translation parameter). In most cases no magnitude information is included with this FSSM data because magnitude adjustment can be accomplished through the MBTAC process described below. However, in some instances the MBTAC process is disabled in which case limited magnitude information may be sent with the FSSM data, although this magnitude information may be a coarse grouping of the relocated upper frequency bands created by the pairs $\alpha_i$, $f_i$.

These FSSM parameters are processed through selection block 30 together with the parameters produced by the ASR block 20 before being forwarded to block 48 (herein referred to as a former 48) where they are formatted into an appropriate transport protocol. It will be noted that the selection block 30 transmits the size of the extended band with two low pass filter block 28, which eliminates any high frequency components that are to be modeled by FSSM or ASR.

UFB and MBTA

To perform the task of shaping the temporal envelope of the reconstructed higher frequency components (in those cases when it is needed) we need to examine time trajectories of the spectral energy in multiple frequency bands. Furthermore, these time trajectories need to be examined at a time resolution that is substantially higher than that afforded by the high frequency resolution MDCT filterbank. For accurate temporal shaping for voiced speech and dynamic musical instruments a time resolution of 4-5 msec (or lower) is desirable. The desired temporal shaping can be computed by utilizing a separate higher time resolution "Utility Filter Bank" (UFB). It is desirable for the UFB to be a complex, over-sampled modulated filterbank because of several desirable characteristics of such filterbanks such as very low aliasing distortion. The magnitude of the complex output of the filterbank provides an estimate of the instantaneous spectral magnitude in the corresponding frequency band. Since UFB is not the primary coding filterbank its output may be suitably over-sampled at the desired time resolution. Several options exist for the choice of the UFB. These include:

(a) Discrete Fourier Transform (DFT) with a higher time resolution (compared to MDCT): A DFT with 64-256 size power complementary window may be used in a sequence of overlapping blocks (with a 50% overlap between 2 consecutive windows)

(b) A complex modulated filterbank with sub-band filters of the form $$h_i = h_0 \cdot e^{j\frac{2\pi}{N}\cdot(i-1)\cdot n}$$

where $h_0$ is a suitably optimized prototype filter. The DFT is a sub-class of this type of filterbanks. The more general framework allows for selection of longer windows (compared to the down-sampling factor).

(c) A complex non-Uniform filterbank; e.g., one with two or more uniform sections and transition filters to link the 2 adjacent uniform sections.

The exact choice of the UFB is application dependent. The complex-modulated filterbanks with a higher over-sampling ratio offer superior performance when compared to the DFT but at a cost of higher computational complexity. The non-uniform filterbank with higher frequency resolution at lower frequencies is useful if envelope shaping at very low frequencies (1.2 kHz and lower) is desirable.

MBTAC

The functional requirement of MBTAC is to extract and code the temporal envelope (or time-frequency envelope) of the signal. Specifically, the signal envelope is analyzed in multiple frequency bands using a complex filterbank called a UFB. In a particular implementation of UFB shown herein as block 44, the signal is filtered in 128 uniform frequency sub-bands and each sub-band analysis is down sampled by a factor of 16.

In block 46 (which contains a categorizer and developer, as described further hereinafter) the over sampled signal, corresponding to a frame of input data (1024 samples) is arranged in a 2-D matrix of size 128×64 (128 frequency bands vs. 64 time samples). These 64 times samples are subintervals of the standard time interval for an MBCT frame (i.e., the MDCT timeframe is 64 times greater). Additional details regarding UFB may be obtained from the above noted reference, Deepen Sinha, Anibal Ferreira, and, Deep Sen "A Fractal Self-Similarity Model for the Spectral Representation of Audio Signals," 118*th Convention of the Audio Engineering Society*, May 2005, Paper 6467. It may also be noticed that due to the complex nature of the UFB output only the first 64 of the 128 frequency bands need to be analyzed.

The detailed time-frequency envelope generated by this process is grouped using a combination of one or more of the techniques described below, which constitute the categorizer of block 46. The bit rate requirement for coding and transmitting the (grouped) time-frequency envelope is further reduced using the techniques described immediately thereafter.

First Level Time-Frequency Envelope Grouping

The initial, finely partitioned, time-frequency envelope is first grouped by assigning UFB sub-bands to N critical ordered frequencies so-bands (each critical band may be a partition using the well-known concept of Bark bands, each containing one or more of the UFB bands). Furthermore, several adjacent time samples are grouped into a single time slot. For the purpose of this time grouping, the system uses either 8 or 16 adjacent UFB time samples. Therefore, the 64 time samples in a frame get arranged into M ordered time slots, here either 8 or 4 time slots. As an illustrative example, assuming there are 17 critical bands between 0 and Fs/2 (Fs being the sampling frequency) after this level of frequency/time grouping, the result is a still relatively fine N×M matrix of 17×8 or 17×4 RMS envelope values (instead of a 128×64 finely detailed envelope). This N×M matrix has a corresponding frequency index and subinterval index and forms an N×M group index. A "base band" envelope is also computed by averaging across the critical bands between 1kHz and 3.5kHz. This base band envelope may be used in a subsequent, optional grouping technique described below (third level frequency grouping).

If no higher level of grouping is performed (i.e. Second Level or Third Level Grouping as described below) coefficients having the same index (from the N×M group index) will be merged using the developer of block 46 to form indexed proxies signifying, for example, the average magnitude of members of the group (an effective recoding with a recoder).

Second Level Time-Frequency Envelope Grouping

The RMS coded time-frequency envelope after the first level of grouping may optionally be grouped through a second level into consolidated collections that combine adjacent envelopes (adjacent in both time and frequency).

Time grouping is first done on each of the M time indices, with successive time slots being grouped if the difference between maximum-minimum RMS values in each frequency sub-band are within a predetermined limitation on magnitude variation (although sub-band to sub-band differences may be rather large). This grouping is performed over the time slots iteratively until reaching that index where, the latest RMS values cause the calculated difference between the maximum and minimum RMS values in the growing collection of time-grouped values to exceed a threshold in at least one frequency sub-band, in which case this latest time slot is not added to the growing collection. Once closed, all the time-grouped values within this collection are replaced with a single RMS averaged value, one for each frequency sub-band.

As the time grouping above and below transition bands might differ in the first level of grouping, based on the preset values, the second level of grouping is done separately above and below the transition band.

The above mentioned time grouping technique is followed with frequency grouping. In particular all of the time groups are evaluated to determine if all time groups can be partitioned with the same frequency breaks to form, two or more common frequency groups where in each frequency group (and in all time groups) the difference between the greatest and the smallest RMS value falls within a pre-specified frequency grouping limit. As before, the averaged RMS value of frequency groups is calculated to replace the grouped values, which then become indexed proxies replacing those of the first grouping.

This grouping is performed so that each of the consolidated collections do not exclude any one of the indexed proxies that intervene by aligning on a. common row or common column (of the N×M group index) contained in the collection. For each of the consolidated collections the encoded signal will include information based on the gross characteristics of the consolidated collection.

Third level Frequency Grouping

Unlike the other two grouping techniques this is done only on frequency envelope. The technique exploits the correlation between the frequency grouped values. The second level of grouping encompasses only those waveforms which are closer in RMS value to their neighbors; this grouping is done depending on the correlation of grouped frequency values. In this technique the time envelopes in each of the higher frequency bands (critical bands or grouped critical bands constituting higher temporal sequences) is analyzed for closeness to the baseband envelope (a pilot sequence having M temporally sequential values developed from one or more of the lower ones of the N ordered frequency sub-bands) computed in the first grouping. If the "shape" of the envelope is close to the shape in the baseband envelope, only a scaling factor is transmitted (instead of the detailed envelope shape).

The following gives an algorithmic description of this grouping technique and computation of the scaling factor.

Figure 9:
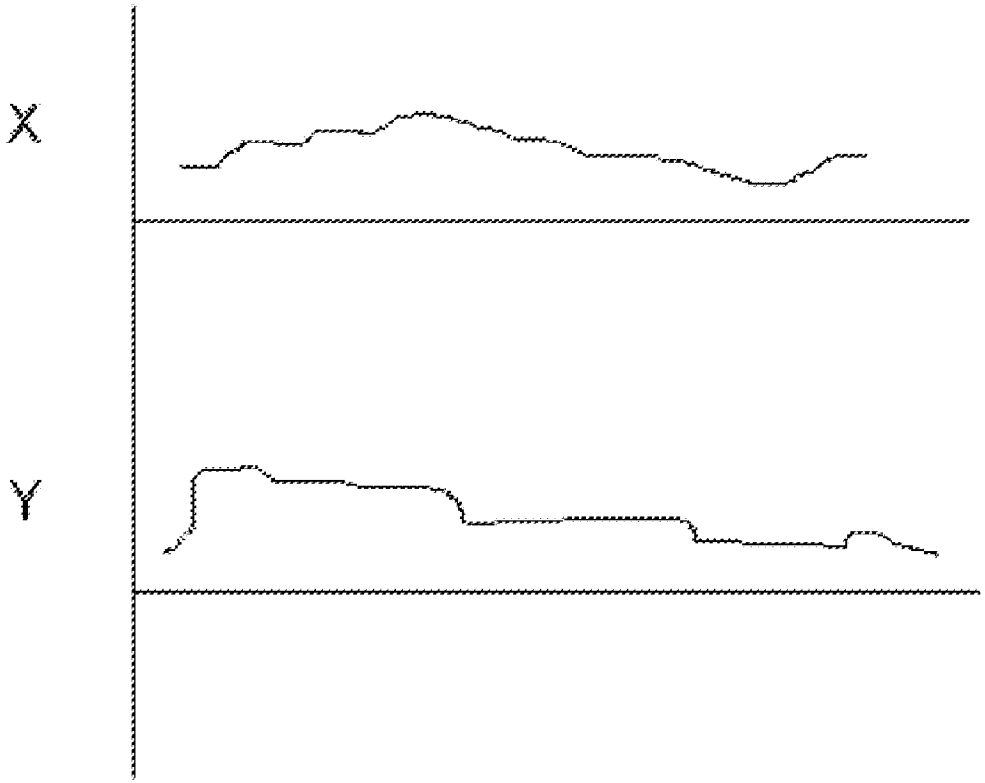
FIG. 9 diagrammatically shows two waveforms X and Y that are to be correlated in accordance with a third level of frequency grouping performed by the encoder of FIG. 1.
Figure 13:
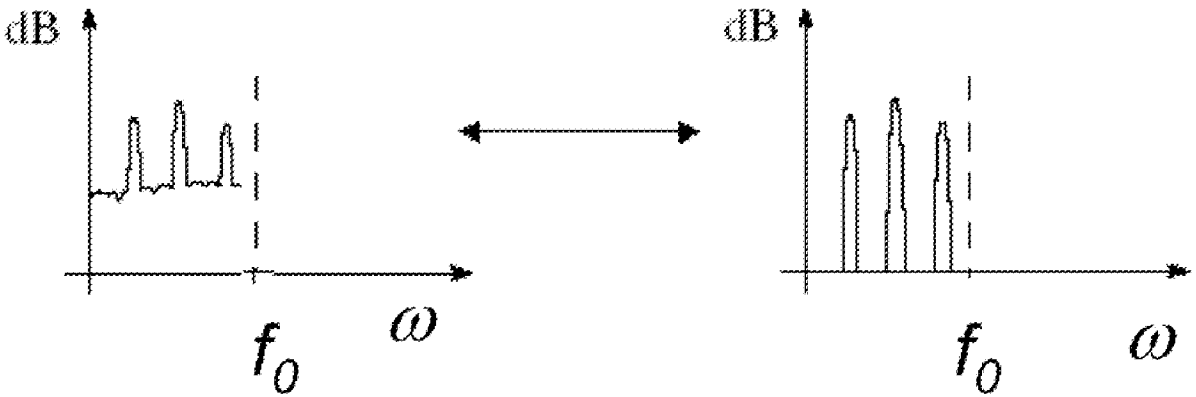
FIG. 13 shows detection of harmonic content from a base band as performed in the decoder of FIG. 2.

FIG. 9 illustrates two monochromatic waveforms X and Y (two vectors, each representing a plurality of time slots in only one respective frequency sub-band). The criterion of this coding technique is to code X and a correlation parameter 'a' (a scalar) into the bit-stream if and only if the reconstructed waveform, say Z=a.X, at the decoder and Y are highly correlated else X and Y are coded separately. Reconstruction of Y, from X and 'a' is done at the decoder. In this process, the criterion of importance is a suitable value for 'a' such that the distance/error in the process of reconstruction is as small as possible.

To find a value 'a' such that the "distance" between 'aX' and Y is as small as possible, following procedure is used. With distance as the criterion consider X and Y monochromatic vectors as shown in FIG. 10. Distance between Y and 'aX' is given by the following separation function:

$$D=(y_1-ax_1)^2+(y_2-ax_2)^2+\ldots+(y_n-ax_n)^2$$

To minimize the value of distance (D) with respect to 'a', begin by differentiating D with respect to 'a' and equate it to zero.

$$\begin{aligned}\frac{dD}{da} &= 2(y_1-ax_1)*(-x_1)+2(y_2-ax_2)* \\ &\quad (-x_2)+\ldots+2(y_n-ax_n)*(-x_n) \\ &= 0\end{aligned}$$

Realigning the above equation, $$a = \frac{x_1 \cdot y_1 + x_2 \cdot y_2 + \ldots + x_n \cdot y_n}{x_1^2 + x_2^2 + \ldots + x_n^2}$$

From the above calculated value of 'a' maximum dB difference between the original (Y) waveform and the reconstructed waveform (Z=aX, that is, programmatic changing of scale) is compared with a predetermined threshold and a decision either to code and transmit as part of encoder bitstream X and Y individually or to code only X and the distance parameter 'a' is made.

Coding of Grouped Values:

The above Time-Frequency grouped values are efficiently coded based on a comparative analysis based on bit demand. There are four different ways of differential coding (recoding) the above grouped Time-Frequency envelope, based on the adjacency along the ordered frequency sub-bands and ordered time slots, defined as follows:

(a) Time-Frequency Differential Coding

In this method, every element of the two dimensional matrix say, $N_{i,j}$ is time, frequency and time-frequency differentially coded (i.e)

$$N_{i,j}=N_{i,j}-(N_{i-1,j}+N_{i,j-1}-N_{i-1,j-1})$$

where $N_{i,j}$ represents the value in the Time-Frequency matrix at $i^{th}$ frequency and $j^{th}$ time instant.

(b) Time Differential Coding

In this method, every element of the two dimensional matrix say, $N_{i,j}$ is only time differentially coded (i.e)

$$N_{i,j}=N_{i,j}-N_{i,j-1}$$

(c) Frequency Differential Coding

In this method, every element of the two dimensional matrix say, $N_{i,j}$ is only time differentially coded (i.e)

$$N_{i,j}=N_{i,j}-N_{i-1,j}$$

(d) No Differential Coding

As the name suggests, no differential coding is done and the individual values are quantized and Huffman coded.

All the above schemes are compared based on their bit demand and the one with the least bit demand is chosen to code the Time-Frequency envelope. This coding produces at plurality of utility coefficients signifying the magnitude for a specific time-frequency coordinate.

The above coding scheme applies equally both for a stereo and a mono file, the above coding schemes are applied to individual images on a stereo file. In addition to the above coding method stereo files are R-L diff coded, to lower the bit demand. In a stereo file R-L diff coding is performed first followed by any of the above coding schemes.

R-L differential coding exploits the temporal similarity of the left and right image of a stereo waveform. In this coding technique Left and Right images are differenced and halved and is stored as the new Left image of the stereo audio and the Left and Right images (from the original audio) are averaged and stored onto the Right image. See FIG. 10 where, $X_L$ and $X_R$ are Left and Right images of the stereo audio. The new values of Left and Right vectors are given in FIG. 11 where, $X_L$ and $X_R$ are new images of Left and Right channel after applying R-L differential coding.

Table 1 shows five default configurations (modes) controlling the assignment of tasks between the FSSM and ASR model as well as a corresponding adjustment in the role of the MBTAC process. It will be noted that the modes are listed in descending transmission bit rate (second column). Also, the top three modes (ST1 through ST3) use a bandwidth expansion range that is 50% of the overall bandwidth (half the sampling frequency $f_s$) produced by the analysis block 10 (FIG. 1), while the last two modes may operate with a larger expansion range.

In mode ST1 the ASR model handles secondary harmonics and isolated tones. In mode ST2 the ASR model handles tonal components. In modes ST3 and ST4, the ASR model handles isolated tones. In mode M1 there is no ASR model functioning. In each of these modes, components that are not handled by the ASR model are handled by the FSSM model.

In modes, ST1, ST3, and ST4 full MBTAC compensation is provided down to the indicated frequency and will handle both the right and left channel (full stereo). In modes ST3 and ST4 MBTAC compensation will be provided to even lower frequencies but this compensation will only correct the ratio (dB difference) between the right and left channels (or equivalently the sum and difference channels often used to represent two stereo channels). In mode ST2 essentially MBTAC compensation is absent and instead some magnitude information is sent along with the ASR and FSSM data indicating magnitudes at least for certain frequency bands. Finally, in monaural mode M1 the MBTAC operates down to 2 kHz. It will be noted that bit rate options are provided to blocks 16, 20, 44 and 46 by a user-controlled options block 50.

TABLE 1

FSSM/ASR/MBTAC DEFAULT CONFIGURATIONS

| Mode Name | Intended Bit Rate Range & Application Type | Bandwidth Extension Range | FSSM/ASR Configuration | MBTAC/Parametric Stereo Configuration |
|---|---|---|---|---|
| ST1 | 45-56 kbps (or higher) - Broadcast | 50% of bandwidth | FSSM for dominant harmonic and non-harmonic components ASR for secondary harmonic and isolated tones | Full Stereo MBTAC from 6 kHz |
| ST2 | 40-72 kbps - Low Complexity | 50% of bandwidth (or less) | ASR for all tonal components FSSM for non-tonal components | Frequency shape only |
| ST3 | 36-42 kbps | 50% of bandwidth | FSSM for harmonic and non-harmonic components ASR for isolated tones | Full Stereo MBTAC from 8 kHz Differential (stereo) MBTAC from 2 kHz |
| ST4 | 24-36 kbps | 50-75% of bandwidth | FSSM for harmonic and non-harmonic | Full MBTAC starting from 4-8 kHz |

TABLE 1-continued

FSSM/ASR/MBTAC DEFAULT CONFIGURATIONS

| Mode Name | Intended Bit Rate Range & Application Type | Bandwidth Extension Range | FSSM/ASR Configuration | MBTAC/Parametric Stereo Configuration |
|---|---|---|---|---|
| | | | components<br>ASR for isolated tones | Differential MBTAC starting from 250-2000 Hz |
| M1 | 12-24 kbps (Mono) or lower | 75% of bandwidth | FSSM for harmonic and non-harmonic components | Mono MBTAC from 2 kHz |

BWE Decoder

Figure 2:
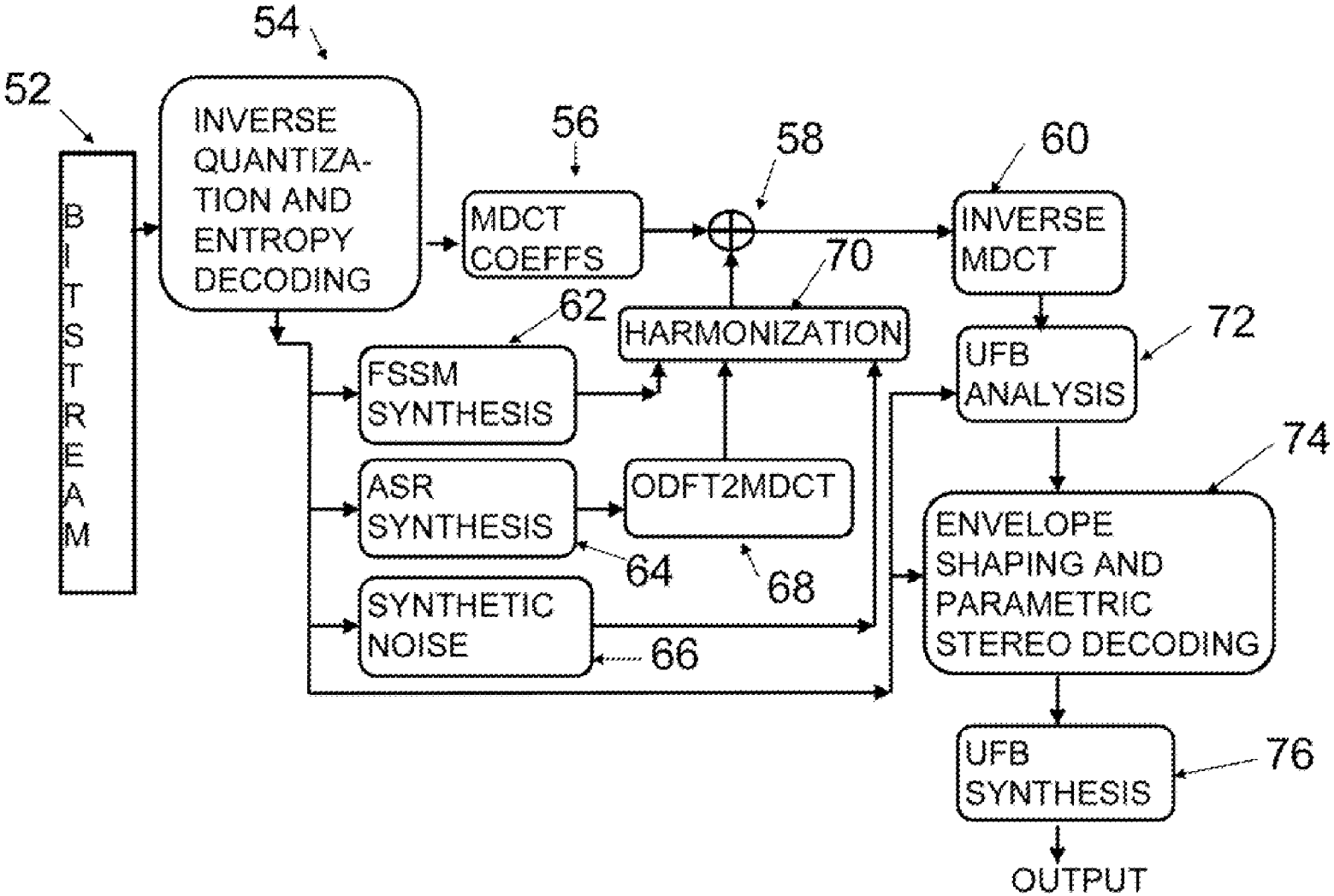
FIG. 2 is a block diagram of a decoder implementing a decoding method in accordance with principles of the present invention.

Referring to FIG. 2, this block diagram indicates an algorithm that may be executed by various types of processors and computers. The bitstream 52 is subjected to inverse quantization and entropy decoding in block 54 to recover MDCT coefficients 56. These MDCT coefficients are also forwarded to blocks 62, 64, and 66 together with recovered ODFT coefficients. In some embodiments, the low pass spectrum 56 is analyzed for harmonic structure that ought to be removed before being passed to the FSSM process (because a band extension model such as ASR will be responsible for harmonic replication in the extended band).

FSSM reconstruction in block 62 is applied on a spectrum that was flattened at the encoder (FIG. 1) by the removal of certain harmonic components, as noted above. On applying dilation and translation parameters with spectral norm values, a high frequency flattened spectrum is approximately reconstructed by the FSSM technique.

ASR reconstruction at the decoder in block 64 involves synthesizing (with a synthesizer in block 64) the harmonic structure and high frequency tonals contained in the encoded information from block 54. The synthesized sinusoids are processed in block 68 (being converted from ODFT to MDCT) and combined in harmonization block 70 with the FSSM full band spectrum from block 62 before being sent to summation node 58. Also, information from decoder block 54 indicating the desired shape of a synthetic noise spectrum is also combined in node 58 with the FSSM and ASR components from block 70 to reconstruct the original spectrum. In block 60 the MDCT coefficients are inverted into a time-domain signal.

In addition, MBTAC parameters passed from block 54 to compensation blocks 72 and 74 (having a inserter and restorer) ensure that the temporal envelope of the original signal is maintained after the reconstruction from the bandwidth extension technique. Adjustment of this temporal envelope is performed in blocks 72, 74, and 76.

MDCT to ODFT Transformation

Returning again to block 54, an MDCT to ODFT transformation proceeds as follows:

The coefficients of an MDCT filter bank can be decomposed as complex ODFT filter bank. The ODFT representation provides magnitude and phase information. MDCT to ODFT and ODFT to MDCT transformation is as given below:

$$X_M(K) = \sum_{n=0}^{N-1} h(n)x(n)\cos\left[\frac{2\pi}{N}(k+1/2)(n+n_0)\right]$$

where $X_M(K)$ is MDCT of the input sequence x(n) and h(n) the windowing function and $n_0=\frac{1}{2}+N/4$.

Taking $0 \leqq K \leqq N/2-1$ it can be shown that, $$X_M(K)=Re(X_0(k))\cos\theta(K)+Im(X_0(K))\sin\theta(K)$$

$$\theta(K) = \frac{\pi}{N}(K+1/2)(1+N/2).$$

ODFT of a sequence x(n) is defined as, $$X_0(K) = \sum_{n=0}^{N-1} h(n)x(n)e^{-j\frac{2\pi}{N}(K+1/2)n}$$

Similarly, a transformation of the MDCT domain to the aliased ODFT domain can be obtained by computing:

$$X_0(K)=2\,[X_M(K)\cdot\cos\theta(K)+j\cdot X_M(K)\cdot\sin\theta(K)]$$

$$\theta(K) = \frac{\pi}{N}(K+1/2)(1+N/2).$$

Aliasing is cancelled in the overlap-add operation following inverse ODFT computation:

$$x(n) = \sum_{k=0}^{N-1} X_0(K)e^{j\frac{2\pi}{N}(K+1/2)n}$$

with $0 \leqq n \leqq N-1$ and $X_0(K)=X_0^*(N-1-K)$ with $0 \leqq K \leqq N/2-1$.

Figure 4:
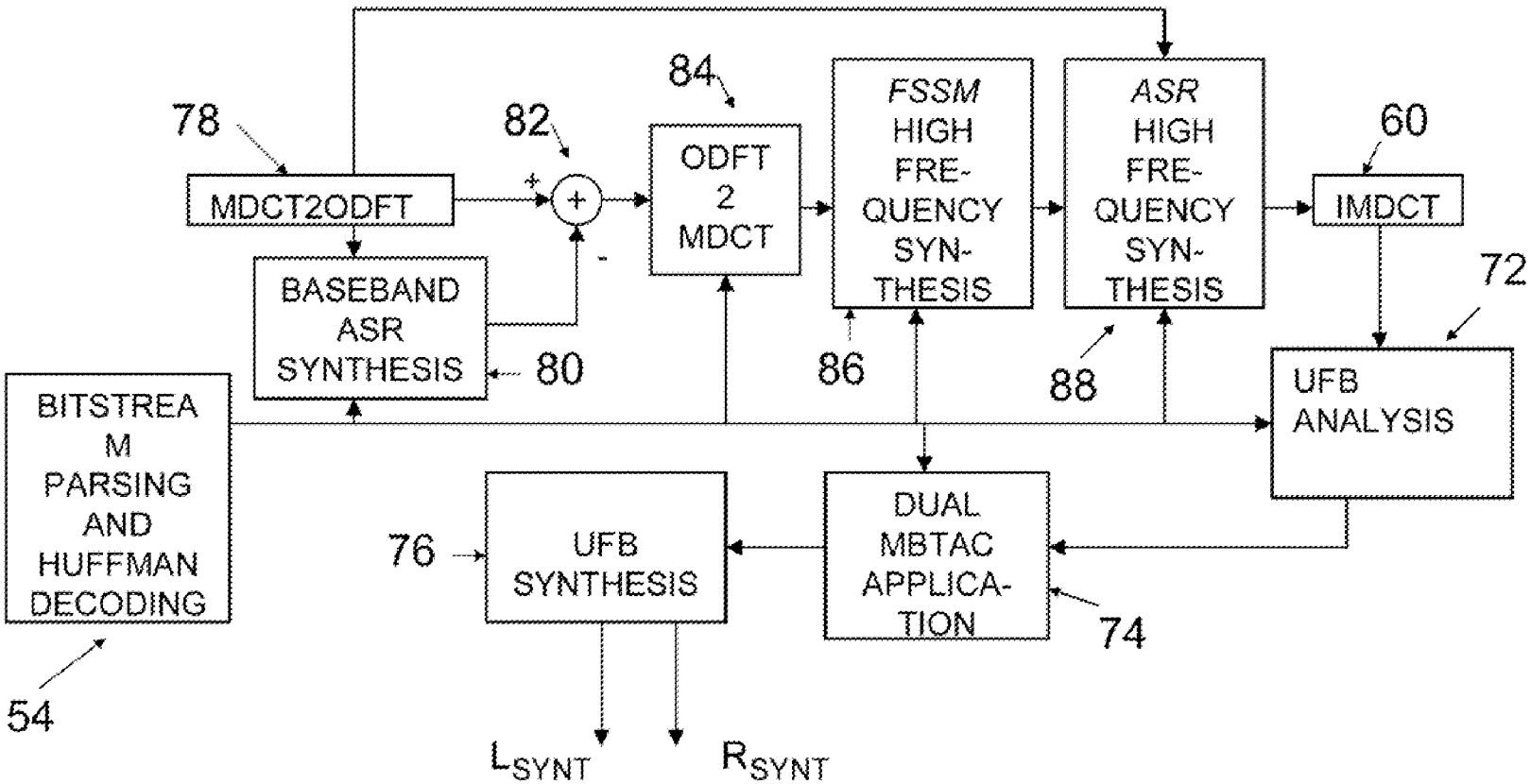
FIG. 4 detailed block diagram showing enhancements to the diagram of FIG. 2.

ASR Analysis:

The purpose of this ASR analysis at the decoder is to create a cleaner baseband from which FSSM synthesis described below can proceed. This aids in avoiding interference between FSSM synthesized components and ASR synthesized components when both the models are in use. Referring to FIG. 4, the foregoing FSSM and ASR synthesis (blocks 62 and 64 of FIG. 2) is revised to provide more accurate reconstruction. (Although components in FIGS. 2 and 4 having the same reference numerals have the same structure and perform the same functions.) The incoming MDCT components are converted in block 78 to ODFT components and applied to the summing input of combining node 82. Also, the ASR data from the coding block 54 is analyzed in block 80 to determine a pattern of ODFT components that are to be ultimately used in the ASR model of reconstruction. The thus identified ODFT components are applied to the subtracting input of combining node 82 to remove from the base band harmonics and tonals that will be processed by the ASR model. See FIG.

Figure 14:
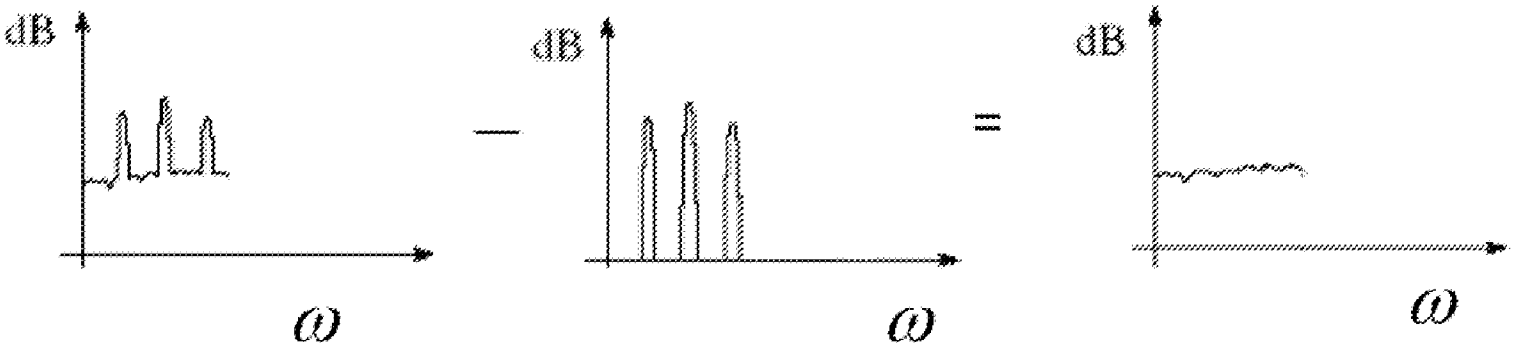
FIG. 14 diagrammatically illustrates on the-left an original low pass spectrum, harmonics detected therein (central diagram), to produce a flattened spectrum, using the decoder of FIG. 2.
Figure 15:
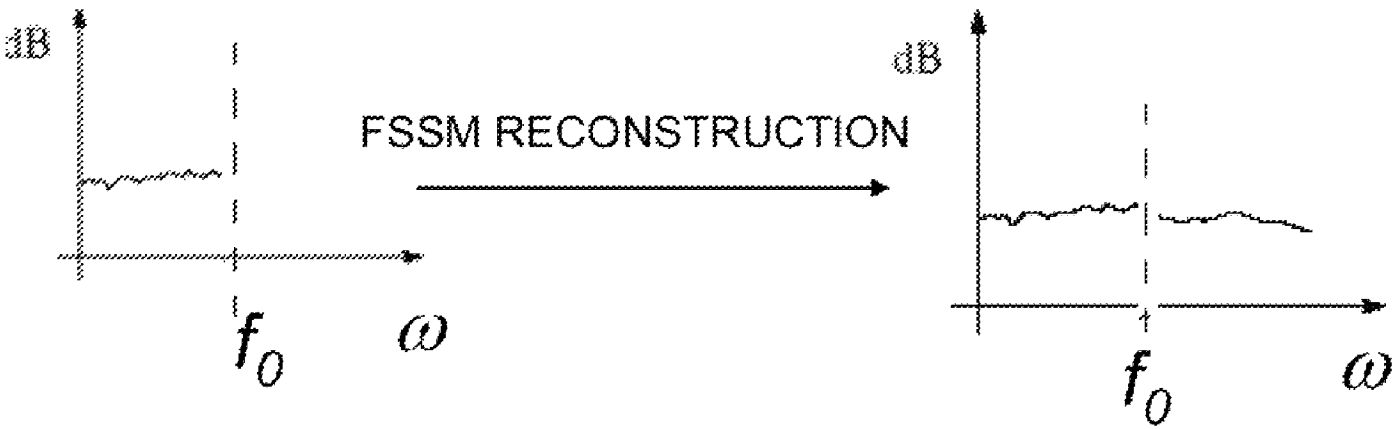
FIG. 15 diagrammatically illustrates FSSM reconstruction as performed in the decoder of FIG. 2.
Figure 16:
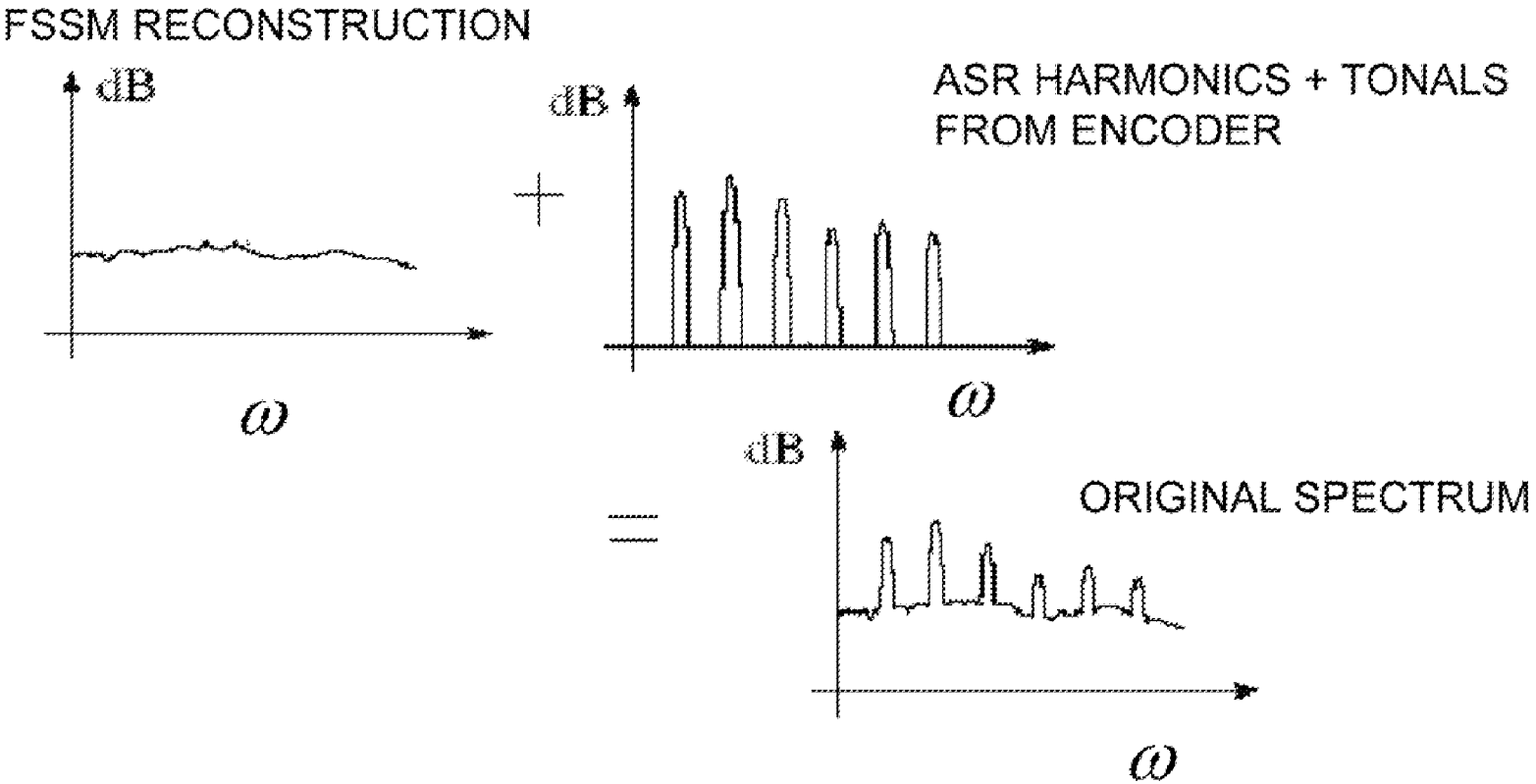
FIG. 16 diagrammatically illustrates in the first two diagrams the spectra reconstructed by FSSM and by ASR, which are combined to produce an original spectrum (last diagram) using the decoder of FIG. 2.

13. In fact this harmonic structure is removed from the incoming spectrum to create a flattened spectrum suitable for FSSM reconstruction. See FIG. 14.

The content of the ODFT spectrum lock 78 may be thought of as a signal, which if converted to the time-domain, would be represented as follows:

$$x_{lowpass} = \sum_{n_1} \sum_{k=1,2} A_{n_1,k} \sin(n_1 \cdot f_k \pi + \phi_k) + \sum \text{noisy_sinusoids}$$

where, $x_{lowpass}$ is the lowpass, time-domain signal of interest and $n_1 K_1/2 \leqq f_0 \forall n_1, K_1$. ASR processing in block 80 involves identifying the values of $An_1$, k, $f_k$ and $\phi_k$. Also, $f_0$ in the above inequality is the cut-off frequency of the spectrum. Upon identifying the harmonics, node 82 eliminates the harmonics in order to smooth the spectrum to one suitable for FSSM processing. In the time-domain, this smoothing process can be considered $$y_{lowpass}(n) = x_{lowpass}(n) - \sum_{n_1} \sum_{k=1,2} A_{n_1,k} \sin(n_1 \cdot f_k \pi + \phi_k)$$
$$= \sum \text{noisy_sinusoids}$$

After this smoothing process, the ODFT components are converted back to MDCT components in block 84.

FSSM Reconstruction:

The flattened low pass spectrum is now extended using FSSM's adjusted pairs of dilation and translation parameters, $\alpha_i$, $f_1$, which were extracted from the bitstream in decoder block 54 and sent to FSSM synthesizer block 86, which includes a relocator. The concept of reconstruction of FSSM from a low band signal is illustrated in FIG. 8.

Specifically, the spectral components in the MDCT base band are multiplied by a first dilation (frequency scaling) parameter $\alpha_1$ and then shifted by a first frequency translation parameter $f_1$. All relocated components (such relocated components being referred to as altered coefficients were altered primary coefficients) that fall beyond the base band are used to create a first FSSM reconstructed sub-band, which is added to the base band to form a first composite band. This first composite band is then subjected to a second dilation parameter $\alpha_2$ before being shifted by a second frequency translation parameter $f_2$. All components relocated thereby (by the relocator) that fall beyond the first composite band are used to create a second FSSM reconstructed sub-band; which is added to the first composite band to form a second composite band. This process is repeated iteratively for all remaining adjusted pairs of dilation parameter and frequency translation parameters to create the FSSM extended band through a growing sequence of composite bands.

After FSSM reconstruction, high band frequencies are normalized coded to maintain the temporal envelope of the original flattened spectrum.

ASR Synthesis:

To reconstruct the original spectrum, the flattened full band signal from block 86 must be supplemented with harmonics and HF tonals, which were ASR coded at the encoder. ASR synthesis proceeds by using the information in the incoming encoded signal that signifies one or more fundamental frequencies and, where applicable, a phase signal. Specifically, fundamentals are identified by ASR information that is sent from block 54 to block 88, with the actual ODFT representation of that fundamental being sent from block 78 to block 88.

Each such fundamental frequency is multiplied in frequency by all the integers between a start and a stop integer to construct harmonics in the extended band (that is, synthesize harmonically related transform coefficients based on the harmonic parameters relayed from block 54). Since ASR works with ODFT components, phasing information is included to maintain proper phasing from harmonic to harmonic. In some cases the incoming encoded signal also includes information about a single tonal (essentially a single sinusoid without harmonics).

In some embodiments the incoming encoded signal includes magnitude information that is used to adjust the magnitude of the synthesized harmonics. In other embodiments, however, no magnitude adjustment is performed except for such adjustment that may be performed in the MBTAC process described hereinafter.

The phase continuity of the tonals/partials is ensured by maintaining the phase of the tonal in co-ordination with previous frame's phase, if any were present, else, a null value is assigned to that particular phase value of the tonal. Using a time-domain representation, the signal may be deemed:

$$x(n) = \sum_{n_1} \sum_{k} A_{n_1,k} \sin(n_1 \cdot f_k \pi + \varphi_{prev \cdot n_1 k_1 tonals})$$

(in case of non-harmonic tonals only the first partial corresponding to $n_1=1$ will be synthesized)

where, $\phi_{prev.n_1 k_1 tonals}$ is expressed as a function of the tonal's frequency value to take care of the phase continuity from the previous tonal values.

All the ODFT components produced by block 88 are converted in that block to MDCT components which are then combined with the FSSM model components from block 86 before being forwarded to block 60 where they are converted from MDCT components to the time domain.

MBTAC Decoder:

Essentially, the MDCT components from block 88 may be considered to have high frequency resolution but its frequencies correspond to a relatively long standard time interval. For the application of MBTAC a higher time resolution is necessary. Therefore, the time domain signal from block 60 is processed by the UFB of block 72 into a number of local coefficients in the time-frequency plane to create a time-frequency matrix that is as fine as the matrix that was created by the encoder UFB analysis.

Desired RMS values of the time-frequency grouped UFB output samples are calculated from the log quantized MBTAC RMS parameters in the incoming encoded signal. Inverse differential coding based on the method chosen at the encoder is done. Inverse R-L differential coding is applied for a stereo signal to recover the R and L RMS values.

Inverse correlation coding is then performed at the decoder to reverse the third level of frequency grouping (in case this was done at the encoder). This is performed by first computing the pilot sequence envelope information from the UFB sub-bands which correspond to the baseband and then determining the corresponding higher frequency envelope by scaling the pilot sequence envelop with the transmitted distance parameters as described above (employing the above noted inserter and restorer). After this is done an inversion of the second level of Time-Frequency grouping, described above is done to fill all Time-Frequency bands. The purpose of this inversion is generate a set of N×M target RMS values for the UFB samples. The partitioning N×M is identical to the partitioning used by the encoder MBATC processor after first level of grouping. Since due to the second-level of grouping only a reduced number of RMS values were coded and transmitted to the decoder (and made available to block 74 by block 54), these values are then mapped to the original N×M grid to determine the desired RMS value at each of these grid point.

The ratio of the desired block RMS computed above and that of the reconstructed spectrum for every time-frequency block (i.e. each point of the N×M grid) is then computed in block 74 and used to scale the complex reconstructed time-frequency UFB samples for that time-frequency block. This ensures, that the envelope of the original spectrum is restored (using the above mentioned restorer) to desired accuracy. The above spectrum is then UFB synthesized in block 76 to regain the time domain signals.

After these components are adjusted by the MBTAC process, the components of the base band and the extended band are now inverted in block 76 to produce the final corrected time-domain signal.

Obviously, many modifications and variations of the present invention are possible in light of the above teachings. It is therefore to be understood that within the scope of the appended claims, the invention may be practiced otherwise than as specifically described.

The invention claimed is:

1. A method for encoding an audio signal, the method comprising the steps of:

transforming the audio signal into a discrete plurality of (a) basic transform coefficients corresponding to basic spectral components located in a base band and (b) extended transform coefficients corresponding to components located beyond the base band;

correlating that is (i) based on at least some of the basic transform coefficients and at least some of the extended transform components and (ii) performed by programmatically determining and applying a primary frequency scaling parameter and a primary frequency translation parameter to form a revised relation between the basic transform coefficients and extended transform coefficients that increases their correlation; and forming an encoded signal based on the basic transform coefficients, the primary frequency scaling parameter and the primary frequency translation parameter.

2. A method according to claim 1 wherein the step of transforming the audio signal employs MDCT.

3. A method according to claim 1 wherein the step of transforming the audio signal employs MDCT and DFT.

4. A method according to claim 1 wherein the step of correlating is performed by:

composing a 1st composite band by combining the basic transform coefficients with relocated coefficients formed by mapping with the 1st adjusted pair from the base band into another band located between the base band's upper limit and its image, said image formed using the primary adjusted pair; and starting with n=2, iteratively:

(a) sequentially adjusting an nth frequency scaling parameter and an nth frequency translation parameter in a predetermined manner and selecting an nth adjusted pair of them that causes the highest correlation, the (n−1)th frequency translation parameter exceeding the nth frequency translation parameter; and (b) composing an nth composite band by combining the (n−1)th composite band with relocated coefficients formed by mapping with the nth adjusted pair from the (n−1)th composite band into another band located between the (n−1)th composite band's upper limit and its image, formed using the nth adjusted pair.

5. A method according to claim 4 wherein the iterative steps of adjusting and composing are terminated after composing the Mth composite band, the step of forming an encoded signal is performed by including the 1st through Mth adjusted pairs.

6. A method according to claim 1 wherein the step of correlating is performed after eliminating from the correlation dominant ones of the basic transform coefficients having a magnitude exceeding to a given extent magnitudes in neighborhoods that are predefined for each of said dominant ones.

7. An encoder for encoding an audio signal including a processor comprising:

a transform for transforming the audio signal into a discrete plurality of (a) basic transform coefficients corresponding to basic spectral components located in a base band and (b) extended transform coefficients corresponding to components located beyond the base band;

a correlator for providing a correlation that is (i) based on at least some of the basic transform coefficients and at least some of the extended transform components and (ii) performed by programmatically determining and applying a primary frequency scaling parameter and a primary frequency translation parameter to form a revised relation between the basic transform coefficients and extended transform coefficients that increases their correlation; and a former for forming an encoded signal based on the basic transform coefficients, the primary frequency scaling parameter and the primary frequency translation parameter.

8. An encoder according to claim 7 wherein the basic transform coefficients are grouped into a plurality of sub-bands with members of each sub-band being assigned a corresponding representative coefficient that is included as a group substitute in said encoded signal to reduce its coefficient count.

9. An encoder according to claim 7 wherein the transform is operable to transform the audio signal with MDCT.

10. An encoder according to claim 7 wherein the transform is operable to transform the audio signal with MDCT and DFT.

11. An encoder according to claim 7 wherein the correlator is operable to sequentially adjusting the primary frequency scaling parameter and the primary frequency translation parameter in a predetermined manner and select a 1st adjusted pair of them that causes the highest correlation.

12. An encoder according to claim 11 wherein the correlator is operable to compose a 1st composite band by combining the basic transform coefficients with relocated coefficients formed by mapping with the 1st adjusted pair from the base band into another band located between the base band's upper limit and its image, said image formed using the primary adjusted pair, the correlator being further operable, starting with n=2, to iteratively:

(a) sequentially adjust an nth frequency scaling parameter and an nth frequency translation parameter in a predetermined manner and select an nth adjusted pair of them that causes the highest correlation, the (n−1)th frequency translation parameter exceeding the nth frequency translation parameter; and (b) compose an nth composite band by combining the (n−1)th composite band with relocated coefficients formed by mapping with the nth adjusted pair from the (n−1)th composite band into another band located between the (n−1)th composite band's upper limit and its image, formed using the nth adjusted pair.

13. An encoder according to claim 7 wherein the correlator is operable to correlate after eliminating dominant ones of the basic transform coefficients having a magnitude exceeding to a given extent magnitudes in neighborhoods that are predefined for each of said dominant ones.

14. An encoder according to claim 7 wherein the transform is operable to provide the basic and extended transform coefficients with some corresponding to one or more standard time intervals and others individually corresponding to one of a plurality of subintervals within said one or more standard time intervals, the encoded signal including a plurality of utility coefficients associated with the plurality of subintervals.

15. An encoder according to claim 14 wherein said utility coefficients are considered a fine matrix whose rows and columns are finely indexed by a frequency index and a subinterval index, the encoder comprising:

a categorizer for categorizing each element of said fine matrix into one of N ordered frequency sub-bands and one of M ordered time slots to non-exclusively form an N×M group index for each element of said fine matrix; and a developer for developing a plurality of indexed proxies by merging those elements of said fine matrix that match under the N×M group index, said encoded signal including information based on said indexed plurality of proxies.

16. A method for decoding a compressed audio signal signifying (a) basic transform coefficients of basic spectral components derived from a base band, (b) one or more frequency scaling parameters, and (c) one or more frequency translation parameters, the method comprising the steps of:

applying the one or more frequency scaling parameters and the one or more frequency translation parameters to the basic transform coefficients to provide a plurality of altered primary coefficients having altered spectral significance; and inverting the basic transform coefficients and the altered primary coefficients to form a time-domain signal.

17. A method according to claim 16 wherein the one or more frequency scaling parameters, and the one or more frequency translation parameters form M adjusted pairs that are ordered, the step of applying parameters being performed by:

applying the 1st of the M adjusted pairs to the basic transform coefficients to produce the altered primary coefficients, and combining the basic transform coefficients with the altered primary coefficients to produce a 1st composite band; and starting with n=2, iteratively applying an nth adjusted pair to the (n−1)th composite band and combining the results lying above the (n−1)th composite band with the (n−1)th composite band to form an nth composite band.

18. A method according to claim 16 wherein the basic transform coefficents correspond to one or more standard time intervals, said compressed audio signal comprising a plurality of utility coefficients individually corresponding to one of a plurality of subintervals of said one or more standard time intervals, the method comprising the steps of:

transforming the time-domain signal into a frequency domain to obtain a discrete plurality of local coefficients individually assigned to a plurality of successive time slots corresponding in duration to the plurality of subintervals;

rescaling the plurality of local coefficients using the utility coefficients from the compressed audio signal; and inverting the rescaled, discrete plurality of local coefficients into a corrected audio signal in the time-domain.

19. A decoder for decoding a compressed audio signal signifying (a) basic transform coefficients of basic spectral components derived from a base band, (b) one or more frequency scaling parameters, and (c) one or more frequency translation parameters, the decoder comprising:

a relocator for applying the one or more frequency scaling parameters and the one or more frequency translation parameters to the basic transform coefficients to provide a plurality of altered primary coefficients having altered spectral significance; and an inverter for inverting the basic transform coefficients and the altered primary coefficients to form a time-domain signal.

20. A decoder according to claim 19 wherein the one or more frequency scaling parameters, and the one or more frequency translation parameters form M adjusted pairs that are ordered, the relocator being operable to applying the 1st of the M adjusted pairs to the basic transform coefficients to produce the altered primary coefficients, and to combine the basic transform coefficients with the primary altered coefficients to produce a 1st composite band, the relocator being operable, starting with n=2, to iteratively apply an nth adjusted pair to the (n−1)th composite band and combine the results lying above the (n−1)th composite band with the (n−1)th composite band to form an nth composite band.

21. A decoder according to claim 19 wherein the basic transform coefficents correspond to one or more standard time intervals, said compressed audio signal comprising a plurality of utility coefficients individually corresponding to one of a plurality of subintervals of said one or more standard time intervals, the decoder comprising:

a transform for transforming the time-domain signal into a frequency domain to obtain a discrete plurality of local coefficients individually assigned to a plurality of successive time slots corresponding in duration to the plurality of subintervals;

a rescaler for rescaling the plurality of local coefficients using the utility coefficients from the compressed audio signal, the inverter being operable to invert the rescaled, discrete plurality of local coefficients into a corrected audio signal in the time-domain.

22. A decoder according to claim 21 wherein said plurality of subintervals are indexed under an N×M group index signifying indexing according to N ordered frequency sub-bands and M ordered time slots.

23. A method for encoding an audio signal, the method comprising the steps of:

transforming the audio signal into a discrete plurality of primary transform coefficients corresponding to spectral components located in a designated band;

correlating based on a correspondence between at least some of the primary transform coefficients and programmatically synthesized data corresponding to a synthetic harmonic or individual sinusoids spectrum comprising any combination of one or more harmonic patterns and one or more individual sinusoids; and forming an encoded signal based on at least some of the primary transform coefficients, and one or more harmonic parameters signifying one or more characteristics of the synthetic harmonic or individual sinusoids spectrum.

24. A method according to claim 23 wherein said encoded signal does not include those ones of the primary transform coefficients that correspond to components of the synthetic harmonic spectrum.

25. A method according to claim 24 wherein said encoded signal includes one or more noise parameters signifying a flattened spectrum produced by eliminating from the encoded signal those ones of the primary transform coefficients that correspond to components of the synthetic harmonic spectrum.

26. A method according to claim 23 wherein the step of transforming is performed by transforming the audio signal into (a) a discrete plurality of basic transform coefficients corresponding to basic spectral components located in a base band, and (b) extended transform coefficients located beyond the base band, the step of correlating primary coefficients being performed by correlating the extended transform coefficients to programmatically synthesized data corresponding to a synthetic harmonic spectrum, the encoded signal including at least some of the basic transform coefficients.

27. A method according to claim 26 comprising the step of:

removing those ones of the extended transform coefficients that correspond to components of a synthetic harmonic or individual sinusoids spectrum comprising any combination of one or more harmonic patterns and one or more individual sinusoids to establish a flattened spectrum.

28. A method according to claim 27 wherein said encoded signal includes one or more noise parameters signifying the flattened spectrum.

29. A method according to claim 27 comprising the step of:

correlating at least some of the basic transform coefficients to at least some of the extended transform coefficients by programmatically determining and applying a primary frequency scaling parameter and a primary frequency translation parameter to recast the relation between basic transform coefficients and extended transform coefficients and increase their correlation, the encoded signal including the primary frequency scaling parameter and the primary frequency translation parameter.

30. A method according to claim 29 wherein the step of correlating basic transform coefficients is performed after eliminating dominant ones of the basic transform coefficients having a magnitude exceeding to a given extent magnitudes in neighborhoods that are predefined of each of said dominant ones.

31. A method according to claim 29 wherein the step of correlating basic components is performed by:

composing a 1st composite band by combining the basic transform coefficients with relocated coefficients formed by mapping with the 1st adjusted pair from the base band into another band located between the base band's upper limit and its image, said image formed using the primary adjusted pair; and starting with n=2, iteratively:

(a) sequentially adjusting an nth frequency scaling parameter and an nth frequency translation parameter in a predetermined manner and selecting an nth adjusted pair of them that causes the highest correlation, the (n−1)th frequency translation parameter exceeding the nth frequency translation parameter; and (b) composing an nth composite band by combining the (n−1)th composite band with relocated coefficients formed by mapping with the nth adjusted pair from the (n−1)th composite band into another band located between the (n−1)th composite band's upper limit and its image, formed using the nth adjusted pair.

32. An encoder for encoding an audio signal comprising:

a transform for transforming the audio signal into a discrete plurality of primary transform coefficients corresponding to spectral components located in a designated band;

a correlation device for correlating based on a correspondence between at least some of the primary transform coefficients and programmatically synthesized data corresponding to a synthetic harmonic spectrum; and a former for forming an encoded signal based on at least some of the primary transform coefficients, and one or more harmonic parameters signifying one or more characteristics of the synthetic harmonic spectrum.

33. An encoder according to claim 32 wherein the primary transform coefficients are grouped into a plurality of sub-bands with members of each sub-band being assigned a corresponding representative coefficient that is included as a group substitute in said encoded signal to reduce its coefficient count.

34. An encoder according to claim 32 wherein said synthetic harmonic spectrum comprises at least two distinct harmonic patterns.

35. An encoder according to claim 32 wherein said encoded signal does not include those ones of the primary transform coefficients that correspond to components of the synthetic harmonic spectrum.

36. An encoder according to claim 35 wherein said form is operable to form said encoded signal to include one or more noise parameters signifying a flattened spectrum produced by eliminating from the encoded signal those ones of the primary transform coefficients that correspond to components of the synthetic harmonic spectrum.

37. An encoder according to claim 32 wherein the transform is operable to transform the audio signal into (a) a discrete plurality of basic transform coefficients corresponding to basic spectral components located in a base band, and (b) extended transform coefficients located beyond the base band, the correlator being operable to correlate the extended transform coefficients to programmatically synthesized data corresponding to a synthetic harmonic spectrum, former being operable to include in the encoded signal at least some of the basic transform coefficients.

38. An encoder according to claim 37 wherein said synthetic harmonic spectrum comprises at least two distinct harmonic patterns.

39. An encoder according to claim 37 wherein the former is operable to remove those ones of the extended transform coefficients that correspond to components of the synthetic harmonic spectrum to establish a flattened spectrum.

40. An encoder according to claim 39 wherein said former is operable to include in the encoded signal one or more noise parameters signifying the flattened spectrum.

41. An encoder according to claim 39 comprising:

a correlator for correlating at least some of the basic transform coefficients to at least some of the extended transform coefficients by programmatically determining and applying a primary frequency scaling parameter and a primary frequency translation parameter to recast the relation between basic transform coefficients and extended transform coefficients and increase their correlation, said former being operable to include in the encoded signal the primary frequency scaling parameter and the primary frequency translation parameter.

42. An encoder according to claim 41 wherein the correlation device is operable to correlate after eliminating dominant ones of the basic transform coefficients having a magnitude exceeding to a given extent magnitudes in neighborhoods that are predefined for each of said dominant ones.

43. An encoder according to claim 41 wherein the correlation device is operable to correlate by sequentially adjusting the primary frequency scaling parameter and the primary frequency translation parameter in a predetermined manner and selecting a 1st adjusted pair of them that causes the highest correlation.

44. An encoder according to claim 43 wherein the correlation device is operable to compose a 1st composite band by combining the basic transform coefficients with relocated coefficients formed by mapping with the 1st adjusted pair from the base band into another band located between the base band's upper limit and its image, said image formed using the primary adjusted pair, the correlation device being operable, starting with n=2, to iteratively:

(a) sequentially adjust an nth frequency scaling parameter and an nth frequency translation parameter in a predetermined manner and select an nth adjusted pair of them that causes the highest correlation, the (n−1)th frequency translation parameter exceeding the nth frequency translation parameter; and (b) compose an nth composite band by combining the (n−1)th composite band with relocated coefficients formed by mapping with the nth adjusted pair from the (n−1)th composite band into another band located between the (n−1)th composite band's upper limit and its image, formed using the nth adjusted pair.

45. An encoder according to claim 32 wherein the transform is operable to provide the primary transform coefficients with some corresponding to one or more standard time intervals and others individually corresponding to one of a plurality of subintervals within said one or more standard time intervals, the former being operable to include in the encoded signal a plurality of utility coefficients associated with the plurality of subintervals.

46. An encoder according to claim 45 wherein said utility coefficients are considered a fine matrix whose rows and columns are finely indexed by a frequency index and a subinterval index, the encoder comprising: a categorizer for categorizing each element of said fine matrix into one of N ordered frequency sub-bands and one of M ordered time slots to non-exclusively form an N×M group index for each element of said fine matrix; and a developer for developing a plurality of indexed proxies by merging those elements of said fine matrix that match under the N×M group index, said encoded signal including information based on said indexed plurality of proxies.

47. A method for decoding a compressed audio signal signifying (a) a plurality of basic transform coefficients corresponding to basic spectral components located in a base band, and (b) one or more harmonic parameters signifying one or more characteristics of a synthetic harmonic or individual sinusoids spectrum comprising any combination of one or more harmonic patterns and one or more individual sinusoids, the method comprising the steps of:

synthesizing one or more harmonically related transform coefficients based on the one or more harmonic parameters; and inverting the basic transform coefficients and the one or more harmonically related transform coefficients into a time-domain signal.

48. A method according to claim 47 wherein the compressed audio signal includes one or more frequency scaling parameters, and one or more frequency translation parameters, the method comprising the step of:

applying the one or more frequency scaling parameters and the one or more frequency translation parameters to the basic transform coefficients to provide a plurality of altered primary coefficients having altered spectral significance, the step of inverting being performed by including the altered primary coefficients when forming the time-domain signal.

49. A method according to claim 48 wherein the one or more frequency scaling parameters, and the one or more frequency translation parameters form M adjusted pairs that are ordered, the step of applying parameters being performed by:

applying a 1st adjusted pair to the basic transform coefficients to provide the primary altered coefficients, and combining the basic transform coefficients with the primary altered coefficients to produce a 1st composite band; and starting with n=2, iteratively applying an nth adjusted pair to the (n−1)th composite band and combining the results lying above the (n−1)th composite band with the (n−1)th composite band to form an nth composite band.

50. A method according to claim 47 wherein the basic transform coefficents correspond to one or more standard time intervals, said compressed signal comprising a plurality of utility coefficients individually corresponding to one of a plurality of subintervals of said one or more standard time intervals, the method comprising the steps of:

transforming the time-domain signal into a frequency domain to obtain a discrete plurality of local coefficients individually assigned to a plurality of successive time slots corresponding in duration to the plurality of subintervals;

rescaling the plurality of local coefficients using the utility coefficients from the compressed audio signal; and inverting the rescaled, discrete plurality of local coefficients into a corrected audio signal in the time-domain.

51. A decoder for decoding a compressed audio signal signifying (a) a plurality of basic transform coefficients corresponding to basic spectral components located in a base band, and (b) one or more harmonic parameters signifying one or more characteristics of a synthetic harmonic or individual sinusoids spectrum comprising any combination of one or more harmonic patterns and one or more individual sinusoids, the decoder comprising:

a synthesizer for synthesizing one or more harmonically related transform coefficients based on the one or more harmonic parameters; and an inverter for inverting the basic transform coefficients and the one or more harmonically related transform coefficients into a time-domain signal.

52. A method for encoding an audio signal, the method comprising the steps of:

transforming the audio signal into a discrete plurality of transform coefficients corresponding to spectral components located in a designated band, some of the transform coefficients corresponding to one or more standard time intervals and others individually corresponding to one of a plurality of subintervals within said one or more standard time intervals;

forming an encoded signal based on (a) the plurality of transform coefficients associated with the one or more standard time intervals, and (b) magnitude information based on the plurality of transform coefficients associated with the plurality of subintervals.

53. A method according to claim 52 wherein said transform coefficients corresponding to one of a plurality of subintervals are considered a fine matrix whose rows and columns are finely indexed by a frequency index and a subinterval index, the method including the step of:

categorizing each element of said fine matrix into one of N ordered frequency sub-bands and one of M ordered time slots to non-exclusively form an N×M group index for each element of said fine matrix; and developing a plurality of indexed proxies by merging those elements of said fine matrix that match under the N×M group index, said encoded signal including information based on said indexed plurality of proxies.

54. A method according to claim 53 comprising the step of:

recoding one or more selections from said plurality of indexed proxies by substituting a value corresponding to a difference between said one or more selections and one or more corresponding adjacent ones of said indexed proxies, adjacency occurring when a pair of indexed proxies separately occupy either (a) an immediately succeeding pair of the N ordered frequency sub-bands or (b) an immediately succeeding pair of said M ordered time slots.

55. A method according to claim 53 comprising the step of:

recoding a selection from said plurality of indexed proxies by substituting a value corresponding to a difference between said selection and a corresponding adjacent pair of said indexed proxies, said adjacent pair separately occupying relative to said selection (a)an immediately preceding one of the N ordered frequency sub-bands, and (b) an immediately preceding one of said M ordered time slots.

56. A method according to claim 53 comprising the step of:

forming one or more consolidated collections from said plurality of indexed proxies, each of the consolidated collections being populated with selected ones of the indexed proxies that together satisfy a predetermined limitation on magnitude variation, each consolidated collection that includes a distinct pair of the indexed proxies will not exclude any intervening one of the indexed proxies that intervene by aligning between the distinct pair by lying on either a common row or common column of the N×M group index, said encoded signal including information based on gross characteristics of the one or more consolidated collections.

57. A method according to claim 53 comprising the step of:

developing from a predetermined number of the lowest ones of the N ordered frequency sub-bands a pilot sequence having M temporally sequential values representative of the M ordered time slots among the predetermined number; and correlating the pilot sequence with higher temporal sequences presented by the M ordered time slots for each of the N ordered frequency sub-bands that are beyond the predetermined number, said encoded signal including information based on results of the step of correlating the pilot sequence.

58. A method according to claim 57 wherein the step of correlating the pilot sequence is performed by pairing the pilot sequence and each of the higher temporal sequences and for each pair: (a) programmatically changing scaling between them, and (b) evaluating them with a separation function to determine whether pair correlation reaches a predetermined threshold before including information on the pair correlation in the encoded signal.

59. An encoder for encoding an audio signal, comprising:

a transform for transforming the audio signal into a discrete plurality of transform coefficients corresponding to spectral components located in a designated band, some of the transform coefficients corresponding to one or more standard time intervals and others individually corresponding to one of a plurality of subintervals within said one or more standard time intervals;

a former for forming an encoded signal based on (a) the plurality of transform coefficients associated with the one or more standard time intervals, and (b) magnitude information based on the plurality of transform coefficients associated with the plurality of subintervals.

60. An encoder according to claim 59 wherein said transform coefficients corresponding to one of a plurality of subintervals are considered a fine matrix whose rows and columns are finely indexed by a frequency index and a subinterval index, the encoder comprising:

a categorizer for categorizing each element of said fine matrix into one of N ordered frequency sub-bands and one of M ordered time slots to non-exclusively form an N×M group index for each element of said fine matrix; and a developer for developing a plurality of indexed proxies by merging those elements of said fine matrix that match under the N×M group index, said encoded signal including information based on said indexed plurality of proxies.

61. An encoder according to claim 60 comprising:

a recoder for recoding one or more selections from said plurality of indexed proxies by substituting a value corresponding to a difference between said one or more selections and one or more corresponding adjacent ones of said indexed proxies, adjacency occurring when a pair of indexed proxies separately occupy either (a) an immediately succeeding pair of the N ordered frequency sub-bands or (b) an immediately succeeding pair of said M ordered time slots.

62. An encoder according to claim 60 comprising:

a recoder for recoding a selection from said plurality of indexed proxies by substituting a value corresponding to a difference between said selection and a corresponding adjacent pair of said indexed proxies, said adjacent pair separately occupying relative to said selection (a) an immediately preceding one of the N ordered frequency sub-bands, and (b) an immediately preceding one of said M ordered time slots.

63. An encoder according to claim 60 comprising:

a former for forming one or more consolidated collections from said plurality of indexed proxies, each of the consolidated collections being populated with selected ones of the indexed proxies that together satisfy a predetermined limitation on magnitude variation, each consolidated collection that includes a distinct pair of the indexed proxies will not exclude any intervening one of the indexed proxies that intervene by aligning between the distinct pair by lying on either a common row or common column of the N×M group index, said encoded signal including information based on gross characteristics of the one or more consolidated collections.

64. An encoder according to claim 60 comprising:

a developer for developing from a predetermined number of the lowest ones of the N ordered frequency sub-bands a pilot sequence having M temporally sequential values representative of the M ordered time slots among the predetermined number; and a correlator for correlating the pilot sequence with higher temporal sequences presented by the M ordered time slots for each of the N ordered frequency sub-bands that are beyond the predetermined number, said encoded signal including information based on results of the step of correlating the pilot sequence.

65. An encoder according to claim 64 wherein the correlator is operable to pair the pilot sequence and each of the higher temporal sequences and for each pair: (a) programmatically change scaling between them, and (b) evaluate them with a separation function to determine whether pair correlation reaches a predetermined threshold before including information on the pair correlation in the encoded signal.

66. A method for processing a decompressed audio signal obtained from a discrete plurality of transform coefficients corresponding to one or more standard time intervals, using magnitude information based on a plurality of transform coefficients corresponding to one of a plurality of subintervals of said one or more standard time intervals, the method comprising the steps of:

inverting the discrete plurality of transform coefficients associated with the one or more standard time intervals into a first time-domain signal;

successively transforming the first time-domain signal into a frequency domain to obtain a discrete plurality of local coefficients individually assigned to a plurality of successive time slots corresponding in duration to the plurality of subintervals;

rescaling the plurality of local coefficients using from the compressed audio signal the transform coefficients associated with the plurality of subintervals; and inverting the discrete plurality of local coefficients into a corrected time-domain signal.

67. A method according to claim 66 wherein said plurality of subintervals are indexed under an N x M group index signifying indexing according to N ordered frequency sub-bands and M ordered time slots.

68. A method according to claim 66 wherein the encoded signal includes a pilot sequence having M temporal sequential values that are representative of M ordered time slots, the method comprising the step of:

populating positions of said N×M group index by inserting in each of a plurality of its N ordered frequency sub-bands a corresponding replica of said pilot sequence.

69. A method according to claim 67 wherein one or more of said plurality of subintervals are designated as recoded, the method comprising the step of:

restoring recoded ones of said subintervals by substituting a value corresponding to a summation between each of the recoded ones and one or more adjacent ones of subintervals, adjacency occurring when a pair of subintervals separately occupy either (a) an immediately succeeding pair of the N ordered frequency sub-bands or (b) an immediately succeeding pair of said M ordered time slots.

70. A method according to claim 66 wherein one or more of said plurality of subintervals are designated as recoded, the method comprising the step of:

restoring recoded ones of said subintervals by substituting a value corresponding to a summation between each of the recoded ones and a corresponding adjacent pair of subintervals, said adjacent pair separately occupying relative to each recoded one (a) an immediately preceding one of the N ordered frequency sub-bands, and (b) an immediately preceding one of said M ordered time slots.

71. A decoding accessory for processing a decompressed audio signal obtained from a discrete plurality of transform coefficients corresponding to one or more standard time intervals, using magnitude information based on a plurality of transform coefficients corresponding to one of a plurality of subintervals of said one or more standard time intervals, the accessory comprising:

a first inverter for inverting the discrete plurality of transform coefficients associated with the one or more standard time intervals into a first time-domain signal;

a transform for successively transforming the first time-domain signal into a frequency domain to obtain a discrete plurality of local coefficients individually assigned to a plurality of successive time slots corresponding in duration to the plurality of subintervals;

a rescaler for rescaling the plurality of local coefficients using from the compressed audio signal the transform coefficients associated with the plurality of subintervals; and a second inverter for inverting the discrete plurality of local coefficients into a corrected time-domain signal.

72. A decoding accessory according to claim 71 wherein said plurality of subintervals are indexed under an N×M group index signifying indexing according to N ordered frequency sub-bands and M ordered time slots.

73. A decoding accessory according to claim 71 wherein the encoded signal includes a pilot sequence having M temporal sequential values that are representative of M ordered time slots, the accessory comprising:

an inserter for populating positions of said N×M group index by inserting in each of a plurality of its N ordered frequency sub-bands a corresponding replica of said pilot sequence.

74. A decoding accessory according to claim 72 wherein one or more of said plurality of subintervals are designated as recoded, the accessory comprising:

a restorer for restoring recoded ones of said subintervals by substituting a value corresponding to a summation between each of the recoded ones and one or more adjacent ones of subintervals, adjacency occurring when a pair of subintervals separately occupy either (a) an immediately succeeding pair of the N ordered frequency sub-bands or (b) an immediately succeeding pair of said M ordered time slots.

75. A decoding accessory according to claim 71 wherein one or more of said plurality of subintervals are designated as recoded, the accessory comprising:

a restorer for restoring recoded ones of said subintervals by substituting a value corresponding to a summation between each of the recoded ones and a corresponding adjacent pair of subintervals, said adjacent pair separately occupying relative to each recoded one (a) an immediately preceding one of the N ordered frequency sub-bands, and (b) an immediately preceding one of said M ordered time slots.

76. A method for encoding an audio signal, the method comprising the steps of:

transforming the audio signal into at least a discrete plurality of transform coefficients corresponding to spectral components located in a designated band, said transform coefficients including a standard grouping and a sub-standard grouping, the standard grouping being associated with one or more standard time intervals, the sub-standard grouping being dividable into a plurality of isofrequency sequences, each of the plurality of isofrequency sequences encompassing said one or more standard time intervals and being associated with a corresponding one of the transform coefficients in the standard grouping, said transform coefficients of said standard grouping each being assigned a masking characteristic for perceptually attenuating spectrally nearby ones of said standard grouping according to a predefined masking function having a predefined domain, and weakening the masking characteristic of each of the transform coefficients in the standard grouping based on the extent its corresponding one of the isofrequency sequences varies and correlates with spectrally nearby ones of the isofrequency sequences.

77. A method according to claim 76 wherein the step of weakening based on sequence variation is performed by evaluating a peak to valley ratio in the corresponding one of the isofrequency sequences.

78. A method according to claim 77 wherein the step of weakening includes the steps of:

calculating a correlation value; and multiplicatively combining the peak to valley ratio and the correlation value to form a comodulation masking release value.

79. An encoder for encoding an audio signal comprising:

a transform for transforming the audio signal into at least a discrete plurality of transform coefficients corresponding to spectral components located in a designated band, said transform coefficients including a standard grouping and a substandard grouping, the standard grouping being associated with one or more standard time intervals, the substandard grouping being dividable into a plurality of isofrequency sequences, each of the plurality of isofrequency sequences encompassing said one or more standard time intervals and being associated with a corresponding one of the transform coefficients in the standard grouping, said transform coefficients of said standard grouping each being assigned a masking characteristic for perceptually attenuating spectrally nearby ones of said standard grouping according to a predefined masking function having a predefined domain, and a weakener for weakening the masking characteristic of each of the transform coefficients in the standard grouping based on the extent its corresponding one of the isofrequency sequences varies and correlates with spectrally nearby ones of the isofrequency sequences.

80. A encoder according to claim 79 wherein the weakener is operable to evaluate a peak to valley ratio in the corresponding one of the isofrequency sequences.

81. A encoder according to claim 80 wherein the weakener is operable to calculating a correlation value; and multiplicatively combining the peak to valley ratio and the correlation value to form a comodulation masking release value.

* * * * *